US007878258B2

(12) United States Patent
Lindström et al.

(10) Patent No.: US 7,878,258 B2
(45) Date of Patent: Feb. 1, 2011

(54) PORTABLE, MODULAR, ACTIVE FIRE PROTECTION INSTALLATION

(76) Inventors: Torbjörn Lindström, Mossvägen 24, S-713 30 Nora (SE); Björn Lundblad, Vännebovägen 9, S-702 30 Örebro (SE)

( * ) Notice: Subject to any disclaimer, the term of this patent is extended or adjusted under 35 U.S.C. 154(b) by 278 days.

(21) Appl. No.: 11/815,894

(22) PCT Filed: Feb. 9, 2006

(86) PCT No.: PCT/SE2006/000184

§ 371 (c)(1),
(2), (4) Date: May 12, 2008

(87) PCT Pub. No.: WO2006/085817

PCT Pub. Date: Aug. 17, 2006

(65) Prior Publication Data

US 2008/0271903 A1 Nov. 6, 2008

(30) Foreign Application Priority Data

Feb. 9, 2005 (SE) ..... 0500320

(51) Int. Cl.

| | |
|---|---|
| ***A62C 37/36*** | (2006.01) |
| ***A62C 37/10*** | (2006.01) |
| ***A62C 37/00*** | (2006.01) |
| ***A62C 13/00*** | (2006.01) |
| ***A62C 13/62*** | (2006.01) |
| ***A62C 13/64*** | (2006.01) |
| ***A62C 13/66*** | (2006.01) |
| ***A62C 31/24*** | (2006.01) |

(52) U.S. Cl. ..... 169/61; 169/30; 169/56; 169/60; 169/71; 239/69; 239/280

(58) Field of Classification Search ..... 169/9, 169/13, 23, 30, 46, 52, 54, 56, 60, 61, 67, 169/70, 71, 74, 76, 85; 239/67, 69, 280, 239/280.5, 281, 373

See application file for complete search history.

(56) References Cited

U.S. PATENT DOCUMENTS

| | | | | |
|---|---|---|---|---|
| 3,713,491 | A * | 1/1973 | Grabowski et al. | 169/61 |
| 4,453,155 | A | 6/1984 | Cooper | |
| 4,609,048 | A * | 9/1986 | Yasaki et al. | 169/61 |

(Continued)

FOREIGN PATENT DOCUMENTS

| | | |
|---|---|---|
| CN | 1377716 | 11/2002 |

(Continued)

*Primary Examiner*—Darren W Gorman
(74) *Attorney, Agent, or Firm*—Connolly Bove Lodge & Hutz LLP

(57) ABSTRACT

The invention relates to a fire protection installation (30) comprising a mist sprayer system with at least one nozzle (5, 10) through which extinguishing medium in the form of liquid is arranged to be sprayed out at high pressure, so that a mist is created for achieving fire extinguishing by means of cooling of combustion gases and the seat of the fire. The distinguishing characteristics are that the fire protection installation is portable and has a modular construction comprising a basic system (31) and a number of customized additional systems, which additional systems comprise different additional units that are adapted to a particular function profile that is set in the actual fire protection installation.

12 Claims, 13 Drawing Sheets

U.S. PATENT DOCUMENTS

| | | | | |
|---|---|---|---|---|
| 4,776,403 | A * | 10/1988 | Lejosne | 169/61 |
| 4,821,805 | A * | 4/1989 | Saito et al. | 169/5 |
| 5,808,541 | A * | 9/1998 | Golden | 340/286.05 |
| 6,257,341 | B1 * | 7/2001 | Bennett | 169/85 |
| 2002/0148621 | A1 | 10/2002 | Yen et al. | |
| 2004/0123990 | A1 | 7/2004 | Sundholm | |
| 2006/0289175 | A1 * | 12/2006 | Gutowski et al. | 169/46 |

FOREIGN PATENT DOCUMENTS

| | | |
|---|---|---|
| EP | 1844819 | 10/2007 |
| GB | 2 156 213 | 10/1985 |
| JP | 930870 | 11/1978 |

* cited by examiner 32
14
55
6
2

1
34
5
58
60
52
6
53
3
22
37

1
50
34
51
15
53
54
6
30
52
48
6

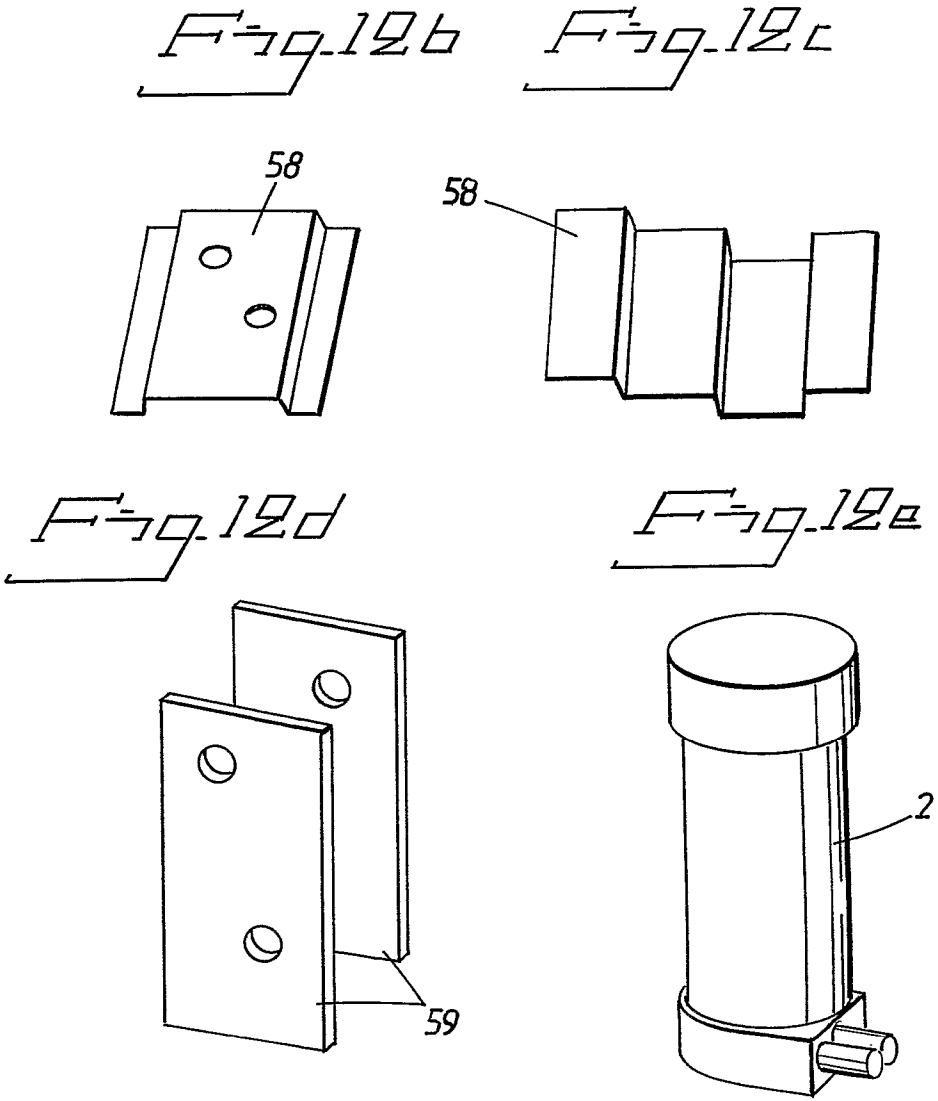
Fig-19c
Fig-19b
Fig-19a
Fig-19d
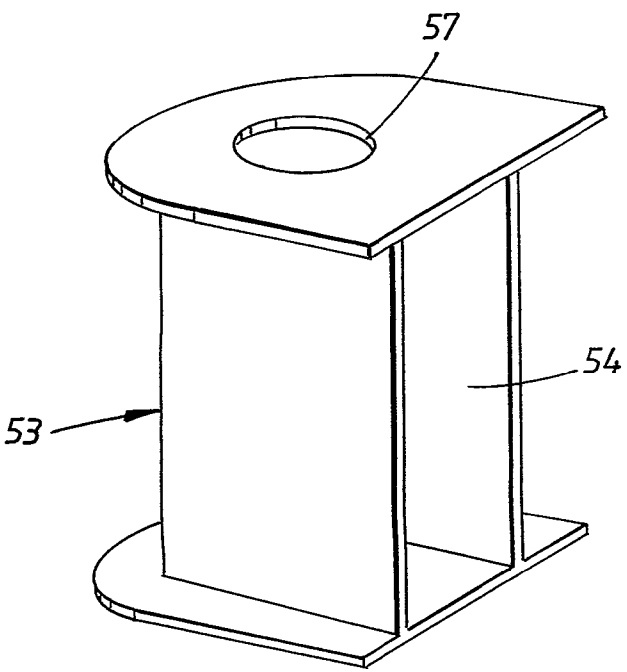
Fig-19a

PORTABLE, MODULAR, ACTIVE FIRE PROTECTION INSTALLATION

RELATED APPLICATIONS

This application is a national stage application (under 35 U.S.C. §371) of PCT/SE2006/000184 filed Feb. 9, 2006, which claims benefit of Sweden application 0500320-7 filed Feb. 9, 2005.

TECHNICAL FIELD

The present invention relates to a portable fire protection installation for temporary installation in a particular determined risk environment, comprising a fire protection system with at least one sensor system for active detection of and reaction to sensor data determined by the said risk environment, comprising, in addition, at least one extinguishing medium container containing an extinguishing medium in the form of liquid, at least one pressurizing system for pressurizing the liquid extinguishing medium, at least one nozzle for carrying out fire suppression and/or fire extinguishing in the determined risk environment by means of the liquid extinguishing medium that is pressurized by the pressurizing system, and at least one pipe system that is arranged between the comprised extinguishing medium containers, pressurizing systems and nozzles.

APPROACH TO THE PROBLEM AND BACKGROUND

Various versions are known of fire protection installations of the type described above. It is typically the case, however, that the known technology for fire protection has not been developed significantly in recent decades. There are today several different fire protection systems intended for either permanent, that is essentially unchangeable, installation in a particular environment or construction, such as, for example, fixed sprinkler installations in buildings, ships, machines, etc, or fire protection systems intended for mobile use from a temporary storage location once a fire has been detected, for example hand-held fire extinguishers, fire engines, etc. The fixed fire protection installations are very expensive, complicated and, in addition, difficult to modify when the risk environment is changed, while the mobile fire protection systems have, of course, the serious disadvantage that they are not in place when fire extinguishing is required.

The known fire protection systems utilize several different extinguishing mediums, such as powder, foam, liquid (usually water) and inert gas (usually $CO_2$ or halon). Physical extinguishing principles are accordingly cooling, wetting or reduction of oxygen. Common to the three of these extinguishing mediums that are mentioned first is that they often cause great damage with consequently high costs for cleaning up. The use of gas as the extinguishing medium involves instead other special risks, as the fire is extinguished by the oxygen content being greatly reduced. This extinguishing medium is therefore not suitable for use in premises that are inhabited, other than only temporarily, by people or animals.

The present invention focuses primarily on liquid as the extinguishing medium and technically the fire extinguishing is essentially carried out by a cooling down of any combustion gases and a cooling down and wetting of the seats of fire by means of the said extinguishing liquid. In most cases, ordinary drinking water is the extinguishing liquid that is the best choice, as water does not have effects that are harmful to health. Other types of extinguishing liquid can, however, be used.

In currently-known fire protection systems based on liquid, in both stationary and mobile systems, it is common for the extinguishing liquid to be sprayed out at a relatively low pressure and with a very large flow, which always leads to the unwanted above-mentioned considerable damage and high clearing-up costs. Such fire protection systems can consist of, for example, units that are permanent or that are ready for use comprising water hoses, fixed water sprinklers, hand-held manual fire extinguishers containing liquid, etc.

In order to avoid these disadvantages, this invention utilizes instead the special technique of spraying out the liquid at a higher pressure through a special mist-spraying nozzle in order, in this way, to create a mist consisting of large quantities of small drops of liquid, which mist fills the surrounding space. The mist thereby cools combustion gases and seats of fire both more rapidly and more effectively than is the case with the abovementioned known fire protection systems based on a large flow of liquid, while at the same time a limited quantity of liquid solely in the form of mist results in no, or little, secondary damage from the extinguishing liquid. The physical extinguishing principles for mist can be divided into:

- cooling of seats of fire, where the mist absorbs large amounts of heat when it is heated up and changes from liquid (water) to gas (steam).
- prevention of heat radiation as the mist effectively absorbs IR-radiation.
- displacement of oxygen when the mist changes from liquid to gas.

Often the three principles apply at the same time and can be difficult to distinguish.

The National Swedish Institute for Materials Testing has carried out comprehensive tests on mist as an extinguishing medium and has found that the fire-fighting properties of water, particularly when it is in the form of mist, are very good, as it is possible to achieve the same or better extinguishing effect with a fraction of the quantity of water in comparison with traditional fire-extinguishing equipment that uses water. The said extinguishing effect is determined principally by factors such as the size and velocity of the drops of water and the aerodynamics surrounding the fire protection installation and along the enclosing surfaces of the object to be protected, preferably its ceiling. These factors affect, for example, the range of the mist, its rate of spread, penetrating properties and cooling properties.

That is, with a higher pressure and with the correct nozzle, it is possible to produce and spread a mist that provides much more effective extinguishing with a considerably smaller quantity of liquid, which results in significantly less damage in total in the event of a fire and, in addition, little or no water damage to clear up after the fire extinguishing has been carried out.

The mist technique is currently used for fire protection in fixed sprinkler installations on, for example, ships and in engine compartments in working vehicles. These installations are, however, at least as expensive as ordinary water sprinklers and often more difficult to install in existing constructions. This applies in particular in those constructions and installations where special attention must be paid to the nature of the object to be protected, for example in computer installations, listed buildings, homes for the elderly, etc. In addition, it is obvious that if changes are carried out to the internal structure of the object to be protected, for example a new installation that must be protected against fire, internal walls in new locations, etc, this is both difficult and expensive to carry out in a fixed system.

New requirements imposed by customers and by the authorities concerning fire protection in different environments demand an improved fire protection system that is both easier to install and that, in addition, is more effective. An initial risk group is residential environments for elderly people with reduced functionality and/or residential environments for people with physical, mental and/or social handicaps.

In these environments, the risk of fire is considerably greater. This risk group is also significantly over-represented when it is a question of injuries or deaths resulting from fires, often as a consequence of difficulties in escaping.

The number of deaths in fires amounts to approximately 150 per year in Sweden, with at least 50% of these being represented by the abovementioned risk group. This risk group includes, for example, people with dementia. According to statistics from the National Swedish Institute for Public Health, 6% of the population over the age of 65 are in this group, which means approximately 90,000 people. It is estimated that 20% of this risk group has an acute need for improved fire protection. The statistics are also representative of other Nordic countries.

In Norway, it has been found from fire statistics that the risk of elderly people dying in association with a fire is four times greater. Most of the deaths occur in the home, where fire protection is often non-existent, which in most cases also applies to those living in institutions. The study covered 253 municipalities and was very disheartening. Fire safety was found to be insufficient in 79% of a total of 2,312 municipal homes for the elderly, in which 24,250 elderly and handicapped people were living. Just the group with documented dementia that live at home is calculated to amount to approximately 30,000 people, and this number is constantly increasing. Norway calculates that safety measures in the form of fire alarms and fixed sprinkler systems will currently require investment amounting to well over NOK 300 million. It has also been found that active fire protection needs to be installed urgently in approximately 12,000 homes (by active fire protection is meant various types of sprinkler system). As a result, there is great interest in new and cheaper types of fire protection.

Another very great problem is that this risk group is rapidly increasing in number at a time when efforts are being made to enable the elderly and/or handicapped to remain in their ordinary home environment as long as possible, even those who are suffering from both physical and social handicaps. At the same time, the average age of the population is increasing, which means that the number of people in this category is increasing rapidly.

When new homes and institutions for the elderly are built today, they are subject to high demands relating to fire safety, both concerning the building techniques and technical protection systems. For already-existing residential environments of this type, the possible safety measures are, however, very limited, due to the lack of suitable fire protection systems and for reasons connected with cost. The installation of traditional fixed fire protection systems (that is sprinkler systems) in an existing building usually requires considerable changes to the property, which makes these solutions both difficult and expensive. Many of the existing fire protection systems have activation principles that are not dimensioned or designed to save lives, but are primarily designed to protect property.

In other words, society and to a great extent the local authorities and property owners are currently facing a huge problem that is both technical and economical when they attempt to find solutions that provide safety for these groups. This is not just a national problem, but is being faced throughout the whole of Western Europe as a consequence of social developments.

Another problematical risk environment is cultural heritage environments of different types, as these can range from small objects to be protected, ancient buildings and irreplaceable museums to whole areas of cities, which, in general, have very poor fire protection and are very difficult to tackle in the event of a fire. Making changes in such buildings is made more difficult by cultural heritage preservation legislation as this requires all changes to be made in such a way that the least possible damage is caused to the object and in such a way that any changes can be restored to the original state. A fixed sprinkler installation is therefore impossible or very difficult to install and, in addition, a fire extinguishing system based on a large flow of water usually results in considerable water damage while at the same time evacuation is hampered by the flow of water, for which reason fire protection installations based on a flow of liquid are unsuitable or are prohibited in cultural heritage premises, premises where expensive or sensitive items are stored or in premises where people and animals reside permanently.

According to the Nordic Safety Authorities, there are currently no fire protection systems commercially available on the market with the required function profile. All the currently known fire protection systems are either designed for manual use or else have one or more other disadvantages, such as, for example, they require complicated and/or expensive permanent installation, they hamper evacuation in the event of a fire, they have too small a capacity in relation to the volume of the room, their operating profile does not correspond to the necessary response time (that is the time that is required for the fire brigade to be able to start putting out the fire), they are not able to actively adapt the fire extinguishing measures that are carried out in response to the current situation and actual development of the fire, they require considerable maintenance and inspection in order to be reliable and, not least, they are very obtrusive and therefore clearly unsuitable in important cultural heritage environments.

There is consequently a great need for a cost-effective, portable, modular, actively detecting, temporary fire protection installation, in which modules can be selected taking into account the relevant risk environment and corrective measures can be carried out in response to the development of the fire, which temporary fire protection installation has a sufficient capacity to control, suppress or preferably extinguish a fire that has arisen, prior to normal fire-fighting activity being carried out, and which fire protection installation is able to be modified simply and at little cost when there are changes to the risk environment in which the fire protection installation is located.

KNOWN TECHNOLOGY

The Japanese patent document JP-A-9 308 701, the Chinese patent document CN-C-1 377 716 and the British patent document GB-A-2 156 213 can be mentioned as some actual examples of known technology associated with the abovementioned problems.

Patent document JP-A-930 870 describes what can almost be likened to a simple, mobile, motor-driven fire-fighting unit in the form of a two-wheeled cart, where the motor-driven pump and the fire hose can be lifted off the cart and carried up to the actual seat of the fire. The device is not intended to be installed for independent, active monitoring of an object to be protected and therefore does not have a control system or sensor system and only extinguishes the seat of the fire by pouring on a large flow of water, which causes precisely the unwanted water damage and clearing-up costs that the present invention aims to solve.

The Chinese patent document CN-C-1 377 716 also describes a simple, mobile, motor-driven fire-fighting unit, which, however, attempts to utilize the mist technology that is of significance for the present invention. The fire-fighting unit that is described is, however, not intended to constitute a temporarily stationary, active fire protection installation and therefore it also does not have a control system and a sensor system for detecting and dealing with a fire.

Finally, the British patent document GB-A-2 156 213 describes an addition to a pressurized cylinder for a hand-held fire extinguisher, which addition comprises a first, conventional sprinkler nozzle, that extinguishes via a large flow of liquid over the seat of the fire in the abovementioned way that is unsuitable as far as the object of the invention is concerned. The device has also a second nozzle, which is not stated to be of the misting type, but instead is described as a "low pressure nozzle" for spreading a conventional water jet with a small projection, as a hand-held fire extinguisher only provides a pressure of approximately 15 bar. This nozzle is also activated manually after the hand-held fire extinguisher has been carried up to the seat of the fire. The said device is thus primarily intended to function as a hand-held fire extinguisher. It is stated that it can also be mounted as an automatic liquid sprinkler point and has therefore a directed action, however with only a flow of liquid, within a greatly restricted area. The device does not have a control system and accordingly it is not possible to make adjustments for different changeable risk environments and the actual development of the fire and it is therefore clearly unsuitable for use in installations that are adapted to suit individual objects.

THE AIM OF THE INVENTION AND ITS CHARACTERISTICS

A principal object of the present invention is thus to provide an improved portable and modular active fire protection installation, preferably in a limited enclosed space or for objects that are to be protected where fixed installations are unsuitable either due to the special nature, cultural heritage value and/or specialized use of the space or of the object to be protected or for reasons associated with cost, that is designed primarily to save lives and secondly to reduce the risks of a fire and to increase the value of what is left after the fire has been extinguished.

Another object of the present invention is to provide an improved portable and modular active fire protection installation that carries out active detection of its surroundings and is activated automatically in the event of a fire, unlike passive response units or fire-fighting units that must be transported manually from where they are stored, for example traditional fire extinguishers, fire engines and the like, where the considerable time spent activating and transporting them is a serious disadvantage.

Another important object of the present invention is to provide a portable, modular, active fire protection installation that can be adjusted for different changeable risk environments, however primarily for residential environments for elderly and handicapped people who have limited functionality and/or limited movement or other risk-increasing patterns of behaviour, such as smoking, drinking and social problems, which fire protection installation can also carry out monitoring, suppression and extinguishing of fires on the basis of a function profile that is pre-selected on the basis of the particular risk environment, which profile can also actively change in response to the requisite operating time and the actual development of the fire.

An object of the present invention is also to provide an improved fire protection installation, which eliminates or at least significantly reduces other abovementioned problems, whereby the favourable effects of the portable, modular, active fire protection installation can be utilized in a better way than was previously the case.

The said objects, and other aims not specified here, are met in a satisfactory way within the framework of what is described in the independent claims. Embodiments of the invention are described in the subordinate claims.

Thus, according to the present invention, an improved active fire protection installation is achieved, comprising a mist-spraying system that is characterized in that at least one of the nozzles in the system consists of a mist-spraying nozzle for creating mist from the liquid extinguishing medium that is pressurized by the pressurizing system to at least 100 bar, and in that the fire protection installation is modular, comprising at least one basic unit, comprising the said fire protection system in the form of a basic system, and a number of additional systems/units selected for this, which additional systems/units comprise different functions for which determined function profiles are adapted and programmed into a control system for controlling the fire protection system's fire suppression and/or extinguishing in the determined risk environment, which basic system and additional systems/units and determined function profiles are pre-selected in accordance with the determined risk environment and which function profiles can also be changed in response to the detected actual development of the fire.

According to additional aspects of a fire protection installation in accordance with the invention:

the fire protection system comprises a power supply unit.

the power supply unit comprises a battery or a reserve power unit.

the pressurizing system comprises an electrical high-pressure pump that is driven by the power supply unit to provide a pressure and flow through the incorporated mist-spraying nozzles, adapted to suit the function profile.

the said at least one mist-spraying nozzle is designed in such a way that the pressurized liquid forms a mist controlled by the control system with a spray angle and projection adapted to suit the function profile.

at least one of the pressurizing system's extinguishing medium containers consists of a pressure tank, which comprises a valve for pressurizing the extinguishing medium in the pressure tank.

the pressure tank is pressurized via the valve to a gas cylinder.

the pressure tank is pressurized via the valve to a gas generator in or outside the pressure tank.

at least one detector device for detecting different data associated with the fire is comprised in the fire protection system, which at least one detector device is arranged to communicate with the control system by wire, fibre or by wireless means.

the fire protection system comprises a communication unit for the said communication with the control system and with internal and/or external alarm systems.

the fire protection system comprises a valve device for a plurality of nozzles and the control system is arranged to handle data from one or more detector devices for causing the extinguishing medium to go via the valve device to the correct nozzles, whereby the fire protection system is arranged to protect several areas.

the fire protection system comprises a nozzle device, which nozzle device comprises a mast on which several nozzles are mounted to increase the area that is covered by the extinguishing medium mist.

the mast is telescopic and its height is arranged to be able to be adjusted upon installation and/or during operation.

the nozzles are mounted on a rotating unit in order to obtain a more even spread of the extinguishing medium mist.

the fire protection system has a level detector on the container for controlling the automatic filling of extinguishing medium via a filling valve.

an operating unit and/or control panel are connected to the control system for manual monitoring and control of the fire protection system.

the fire protection system comprises a data input for manual reading off of data and modifying of the software/function profiles in the control system in response to a particular risk environment and/or in response to the particular fire protection installation configuration.

the fire protection system comprises alarm signal devices and/or emergency lighting units controlled by the control system's function profiles.

the pressure created by the pressurizing system is between 100 bar and 150 bar, preferably 130 bar.

ADVANTAGES AND EFFECTS OF THE INVENTION

The present portable, actively detecting, modular fire protection installation that can be set and changed in response to the relevant risk environment and in response to the actual development of the fire in accordance with the invention, and its additional embodiments, represents a completely new type of fire protection system solution that fills the gap between mobile response units and permanently-installed sprinkler systems. Known techniques and known technologies are combined with innovation to create in a new way a fire protection system solution that provides completely new possibilities, effects and advantages. Examples of the criteria, and combinations of these, that have determined the development of the said fire protection installation and that make its design quite unique are, among others, the facts that:

- All main functions are integrated in a single basic system comprising a basic unit, that is installed on site in a particular determined, analysed risk environment ready for immediate use and on the basis of the said analysis, which basic unit is designed, as far as its size, weight, design and function are concerned, in such a way that it can easily be moved, adjusted or re-programmed if the risk environment changes.
- The control system/control unit of the fire protection installation has been provided with an advanced, programmable microprocessor that is highly "intelligent", whereby it is possible to set and later adjust parameters for different function profiles and operating profiles. The fire protection installation can therefore be freely modified in response to precisely the relevant risk situation and residential environment, but the fire protection installation can also be easily adjusted if these parameters should change.
- The fire protection installation comprises function profiles and operating profiles that mean that the fire protection system initiates fire extinguishing or fire suppression, while escape/evacuation is still possible.
- The fire protection installation optimizes applicable parameters, such as liquid pressure and spray angle for the mist, so that an optimal production and spraying of the extinguishing medium in the form of mist is achieved, so that, in particular, the size and velocity of the drops of water and the aerodynamics are optimized.
- Via the control system's function profiles, the fire protection installation can be linked to a particular type of person at risk instead of to a particular type of premises, and also to a combination of these.
- The fire protection installation comprises a general basic system, and associated suitable, optional additional functions/systems have been created, all of which can be controlled and can be combined in a simple way into different configurations in order to suit the greatest number of possible installation options. For example, an additional function is the ability to communicate (also in both directions) with all security and alarm systems that are available on the market and that can be considered to be of relevance in this connection.
- The fire protection installation comprises a customized design that means that the fire protection system can be located in all possible environments without having an adverse effect on existing interior design and cultural heritage considerations.
- The fire protection system comprises facilities for manual activation and deactivation where such can be permitted. The risk of secondary damage in the event of activation, or if an unwanted activation should take place, is minimized by the use of mist instead for liquid sprinklers, in combination with the control system's specially selected function profiles for the object to be protected.
- The fire protection system comprises facilities for simple and reliable maintenance during which all the functions of the fire protection system can be checked.
- The function profiles that are customized, pre-programmed and re-programmable via the control system in response to changes in the risk environment make it possible to actively adapt and vary the fire extinguishing measures that are carried out in response to a particular situation, taking into account the estimated response time for fire-fighting units to which alarms have been sent, in combination with the actual development of the fire.

In order to fulfil the abovementioned criteria in a satisfactory way, this invention is based on the use of known mist technology in a portable/mobile, actively detecting and automatically reacting fire protection installation, that can be adjusted for different utilization profiles based on, for example, a particular type of person at risk, risk environment, requisite response time. Various additional system modules/units with various additional functions that are of significance for the relevant installation, the object to be protected and the design, can be added to a first basic system, which basic system comprises the basic functions for a basic portable active fire protection system. The present fire protection system with different additional units provides the advantages of mist technology together with a considerably more rapid and simpler installation, without any effect or with a very small effect on the existing environment, and at a much lower cost.

Mist has a unique ability to absorb heat, and concealed fires can also be controlled as, in principle, the mist fills all the space that is to be protected. Extinguishing is thus carried out by cooling down of the combustion gases, cooling down of the seat of the fire and surrounding areas, reduction of the oxygen concentration and absorption of the heat radiation. The extinguishing effect is determined principally by factors such as the size and velocity of the drops of water and the aerodynamics around the installation, that is, for example, the currents of air that arise between active nozzles and the casing of the installation and along surrounding surfaces of the object to be protected, preferably its ceiling but also surrounding walls, and fixtures and fittings that affect the currents of air that have arisen and the spread of the mist in the space to be protected.

The design of the casing together with the design and position of the nozzle are arranged in such a way that the spraying of the mist is optimal with regard to the abovementioned aerodynamic effects. The currents of air between nozzle and casing, along the ceiling, etc, are calculated. By constructing, designing and positioning the fire protection system in accordance with the actual risk environment, advantageous aerodynamics are achieved for an optimal distribution of the water particles in the mist and in the room. An evenly distributed spread of drops that fills the whole of the space in question and that has a minimal direct wetting action against any surfaces is the objective, as the extinguishing effect is reduced by a direct wetting action.

The distribution of the size of the drops of liquid in the mist is controlled by a combination of the physical design of the nozzle and the pressure of the extinguishing medium through the nozzle. The theoretically optimal distribution with regard to the extinguishing effect is obtained with drop sizes that are approaching 0 μm in diameter, which is both impossible in practice and is not actually required. In practice, an even distribution of drop sizes should be the objective, with the larger drops providing several required effects. The larger drops have a longer projection from the nozzle, that is they are slowed up less by the air due to their relatively large mass. In addition, larger drops are able to penetrate the seat of the fire and cool down the fire at its core.

The function profiles of the fire protection installation are therefore designed to provide an optimal distribution of the drop sizes by a systematic testing of different nozzles at different system pressures.

In order for the mist to be able to spread quickly and effectively, the water drops from the nozzle are required to have a high velocity. As the air quickly slows up the smaller drops in particular, this emphasizes yet again the need for the drops to have a high initial velocity. The velocity of the drops is determined primarily by the pressure and secondarily by the design of the nozzle. The nozzle is therefore designed to distribute the water with the required distribution of drops with, at the same time, a minimal slowing up of the velocity of the jet.

Other advantages are the low consumption of extinguishing medium and the early activation via the intelligent control system, comprising an optimal function profile selected in response to the actual risk situation.

An optimal function profile can comprise, for example:

- Simple and rapid installation of suitable data for the risk environment, for example via a control panel or via a data bus and portable computer (laptop, hand-held computer, etc).
- Early activation by means of sensors arranged in close association with established sources of risk in order to make possible escape/evacuation (life-saving) and optimal reduction of damage.
- Sufficient capacity for protecting the room and any contents, as laid down by the safety regulations.
- An operating profile that at least corresponds to the estimated response time.

Examples of existing environments and premises where an installation of the present invention can be relevant are, for example, residential environments, home environments for the elderly, hospitals and nursing institutions, public environments, workshop environments, schools, storage premises, business environments, manufacturing environments, fuel depots, museums, community centres and agricultural buildings, etc. It is, of course, also possible to install special installations in, for example, busses, caravans, pleasure boats, etc. The fire protection installation according to the invention is very easy to install and can easily be moved with the resident or to alternative premises where there is an increased risk.

Additional advantages and effects will be apparent from study of the following detailed description of the invention and a number of its advantageous embodiments, the claims and the accompanying drawings.

BRIEF DESCRIPTION OF DRAWINGS

The invention will be described in greater detail in the following, with reference to the attached drawings in which.

DETAILED DESCRIPTION OF EMBODIMENTS

Figure 1:
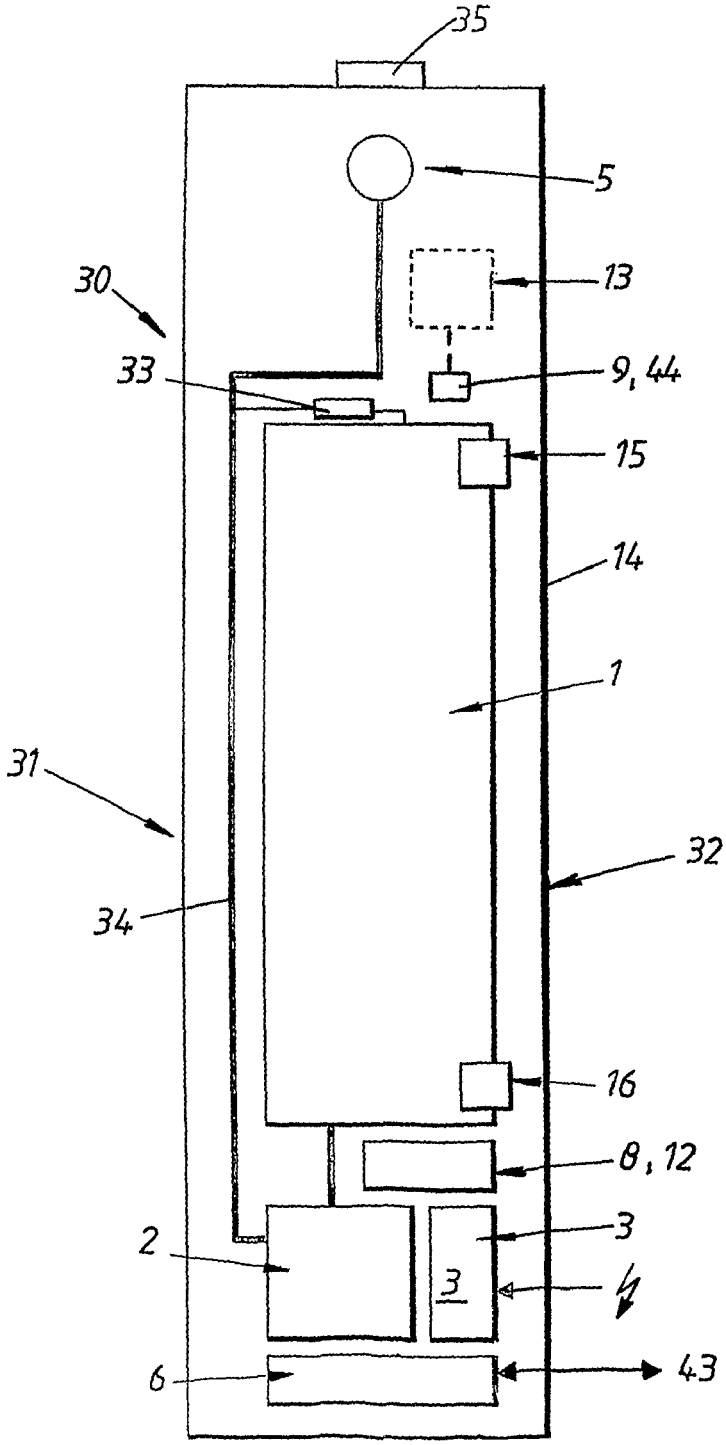
FIG. 1 shows a schematic drawing of parts of a fire protection installation according to a first embodiment of the present invention, which fire protection installation can be considered to consist of a suitable basic system and to which basic system additional modules and functions can be added in accordance with a particular risk environment and function profile required for this.

With reference to FIG. 1, a drawing of parts of a first embodiment of a fire protection installation 30 according to the present invention is shown schematically, which first embodiment can be considered to comprise a basic, complete fire protection system 31 (for this reason also called a basic system 31 below), as it comprises the most important components and functions for the invention in a single combined portable basic unit 32. A number of additional systems that are described below, comprising additional, different function modules and function profiles, can then be added to this basic system 31 in accordance with expected customer requirements and operating profiles for a particular risk environment.

The fire protection system 31 according to this first embodiment of the fire protection installation 30 comprises a power supply unit 3 which supplies the basic system 31 preferably with standard voltage via the existing power network, but which basic system 31 can be provided with the requisite power via alternative power sources, see also below. The fire protection installation 30 comprises, in addition, a sensor system/sensor unit 13 comprising at least one detector/sensor module 9, 44 for the said active detecting of the particular risk environment, at least one extinguishing medium container 1 containing an extinguishing medium in the form of liquid, a pressure system 2 for pressurizing the liquid extinguishing medium from the extinguishing medium container 1, which for this reason is also called the pressurizing system 2 in the following, and comprising a pressure-relief valve/pressure-reducing valve 33, at least one mist-spraying nozzle 5 for creating mist from the liquid extinguishing medium that is pressurized by the pressurizing system 2, a pressure pipe system 34 arranged in an inner pipe circuit between the extinguishing medium container 1, the pressurizing system 2 and the said at least one mist-spraying nozzle 5, which fire protection system 31 is arranged, in the event of an alarm from the sensor system 13, to spray out the extinguishing medium liquid at such a high pressure through the mist-spraying nozzle 5 that the said mist is created to bring about fire suppression and/or fire extinguishing in the determined risk environment, in particular, by cooling of any combustion gases and seats of fire. This is carried out via the function profiles that are programmed into a control system 6, are pre-selected or are determined by the actual development of the fire, comprising important calculated or estimated parameters based on, for example, physical, geometrical, social, economic and/or cultural values for precisely that particular risk environment. The basic system 31 shown in FIG. 1 and all or particular additional systems selected for this, in the case of other embodiments according to the invention, are enclosed in a portable mist-sprayer unit/basic unit 32 with a casing 14 that is aesthetically customized and functionally designed with regard to outer and inner design and system function, the design and material of the casing being determined by the selected fire protection system solution and function profile. The casing 14 forms the outer cover for the fire protection system 31 and can be simply modified in colour and design according to requirements. The casing 14 can be provided with a lock function and tamper-proofing (not shown) for minimizing unwanted external influences. On the casing 14 there are one or more adjustable stabilizers 35 that prevent the basic unit 32 from being tipped over accidentally after installation, the number of these being determined by the relevant construction or enclosing surfaces surrounding the basic unit 32.

The extinguishing medium container 1 of the fire protection installation 30 consists preferably of a single water tank 1 containing ordinary clean tap water, but it is recognized that there can also be several separate extinguishing medium containers 1*a*, 1*b*, see in particular FIG. 13 *a*, each containing a suitable liquid, powder, foam or gas, to which extinguishing medium containers 1*a*, 1*b* one or more special nozzles 5, 10 that are suitable for the content of these containers are connected in addition to the ordinary mist-sprayer nozzle 5. The present invention is intended in particular to utilize water for mist-spraying as the extinguishing principle, but this does not mean that it is not possible to increase the fire extinguishing possibilities if the risk environment permits this.

The number of extinguishing medium containers 1 and their content, volume, material and physical design are dependent upon the estimated risk environment and the function profile selected in response to this. In particular cases, the extinguishing medium has an admixture of special additives such as foaming agent and means for preventing or at least minimizing the risk of the growth of bacteria and algae. The extinguishing medium container 1 is manufactured in a material that is not transparent (and that also blocks wavelengths within the UV-range) in order to prevent the said growth, as algae and bacteria require light and oxygen in order to grow. In particular cases, a foaming agent can provide a better extinguishing effect, but this improvement is judged to be marginal. The difficulty of evaluating the effects of storing water with a foaming agent for a long period of time, together with the marginal improvement in effectiveness, mean that ordinary water without foaming agent is normally preferable. In addition to the said pressure-relief valve 33, the extinguishing medium container 1 has a valve 15 for manual filling of extinguishing medium and a valve 16 for drawing off extinguishing medium. The pressure-relief valve 33 regulates the pressure in the pipe system 34 and prevents damage to the pressurizing system 2 in the event of any overpressure. The extinguishing medium container 1, and also other components where appropriate, are preferably manufactured of a thin, cast, pressed or injection-moulded plastic, composite or metallic material that normally only needs to withstand the natural pressure of the intended content. In the embodiment shown in FIG. 5, however, the container 25 for the extinguishing medium is of the pressure vessel type, described in greater detail below.

The extinguishing medium is taken from each extinguishing medium container 1 through the pipe system 34 to the pressurizing system 2, either by means of its said natural pressure or by conveyance/expulsion by means of the pressurizing system 2 itself. For example, when the pressurizing system 2 comprises an electric pump 2, see in particular FIG. 12, the conveyance/expulsion can be carried out by pumping. Other pressurizing methods depending upon the system solution, such as pyrotechnic gas generation or pressurized gas, will also be described in greater detail below. In the basic version, however, the pressurizing system 2 preferably comprises the said electrical high-pressure pump 2 that is driven by the power supply unit 3. The power supply unit 3 consists preferably of an ordinary mains unit with requisite output and voltage, but can, if required, be supplemented or replaced by other energy sources, see in particular FIG. 2, such as a battery 36 or a specially-designed reserve power unit 37.

The pressurizing system 2 conveys the extinguishing medium through the pipe system 34 and out to all the mist-spraying nozzles 5, 10, 20 in the fire-fighting installation, see FIGS. 2, 3, 4, 7, with the extinguishing medium that is pressurized by the pressurizing system 2 being given a flow and overpressure that is adapted to suit the relevant fire protection system solution/function profile and with the extinguishing medium being projected out through the mist-spraying nozzles 5, 10, 20, in such a way that the mist cloud that is created spreads rapidly throughout the space in a way that is required for the best fire-fighting result to be achieved, see in particular FIG. 7, that is with regard to the optimizing factors that are dimensioned for the function profile that is utilized, for example direction, projection, spray angle, velocity, size of drops, distribution of drops, etc. The mist cloud penetrates and surrounds any seats of fire and combustion gases and preferably fills up all the available space in which the mist-spraying nozzles 5, 10, 20 are located. The mist cools any combustion gases effectively and extinguishes or at least greatly suppresses the seat of the fire until external fire-fighting units arrive. In order to obtain the correct drop size and to obtain the projection that is required to fill the space with mist, the pressurizing system 2 increases the pressure of the extinguishing medium through the mist-spraying nozzle(s) 5, 10, 20, to approximately 100-150 bar, in comparison to 1-10 bar for a conventional water sprinkler system. In tests, a pressurizing of the extinguishing medium to approximately 130 bar has been found to be advantageous.

In addition to the abovementioned distribution of drops, etc, each mist-spraying nozzle 5, 10, 20, is designed and located in such a way that mist is created with the most effective spray characteristics in the particular risk environment for the particular function profile, for example determined in response to the volume, internal shape of the risk environment, taking into account obstructing inner walls, the location of sensitive fixtures and fittings, etc, see in particular FIG. 7. The spray characteristics of the mist are largely dependent upon which initial spray angle is selected. The location and selection of the mist-spraying nozzle 5, 10, 20, is thus important for achieving maximal function. The mist-spraying nozzle 5 in the basic unit 32 of the basic system 31 is therefore suitably located, see in particular FIG. 8, at the front 38 of the casing 14 and close to its top 39, that is, in many objects to be protected, close to an existing ceiling. The nozzle or nozzles 5, 10, 20 can suitably also be disconnected from the basic unit 32 in a simple way and mounted in a different position, see FIGS. 7, 9*b*.

The control system 6 incorporated in the fire protection installation 30 controls and monitors all functions of the whole of the fire protection system 31. For this purpose, the control system/control unit 6 comprises at least one advanced, programmable microprocessor that is highly "intelligent", that is the microprocessor has been provided with specially-developed software for precise customizing and modifying to suit the object to be protected, whereby it is possible to set and later adjust parameters for different function profiles and operating profiles. By means of these function profiles and operating profiles, that are programmed into the control system 6, are pre-selected or are determined by the actual development of the fire, and comprise important parameters based on, for example, physical, geometric, social, economic and/or cultural values calculated or estimated for precisely that particular risk environment, the fire protection system 31 is arranged, in the event of an alarm from the sensor system 13, to initiate fire extinguishing, or fire suppression, while escape/evacuation is still possible. The fire protection installation 30 can be freely adapted in response to precisely the risk situation and the residential environment that is applicable but the fire protection installation 30 can also be modified easily if the said parameters are changed.

The control system 6 is modular in construction and can be connected in parallel to several basic units 32, see in particular FIG. 9 *a*, and additional units. For example, in the embodiment shown in FIG. 2, the control system 6 provides, via a communication unit 40, bilateral communication between several mist-sprayer units/basic units 32, several individual sensor systems/sensor units 13, 22 comprising different detectors 9 and 11 that are respectively on the basic unit 32 and at a greater distance from this, etc, and also bilateral communication with internal 7 and external alarm systems 21, such as alarm centers, etc, so that remote control can be carried out. The fire protection installation 30/system 31 has an input 43 via the control system 6 to enable data to be read off manually and for manual modifying of the software. The control system 6 is arranged to continually monitor particular selected critical safety functions and to control and monitor all other functions of the function modules/additional units that are connected to the fire protection system 31 in both passive operation and in active operation.

These functions can comprise for example:

- communication with the internal and external detectors 9, 11 and the internal sensor system 13 for detection of smoke and heat and handling of this sensor information.
- handling of additional sensor systems 22, for example TV-camera, IR-detector, gas sensor and particle detector, etc.
- manual activation via the control panel 12.
- activation of the fire protection system 31 in the event of an alarm, comprising, for example, activation of the pressurizing system 2, switching on of the emergency lighting units 41.
- communication with and triggering of an internal alarm 7 comprising devices 42 for sound and/or light signals on the basic unit 32, on external sensors 11 and/or on the control panel 12 associated with the object to be protected.
- communication with external alarms and alarm centers 21 or other external parties responsible for responding to alarms and remote control from there. This can also be utilized for any tamper alarm on the object to be protected and on the installation.
- communication between control systems 6 in the basic unit 32 and in the other additional units.
- communication with the valves 15, 16, 18 and level detectors 19, see also FIG. 3, for control of filling in the event of a low level of extinguishing medium and of drawing of f in the event of relocation of the fire protection installation 30.
- communication with service equipment via the data input 43.

The control system 6 comprises both manual and automatic testing of the fire protection system 31, which can be carried out upon installation, during operation and when maintenance service is carried out. The control system 6 monitors and logs in real time all events and detected stimuli such as sensor data, commands, alarms, etc, including alarms in the event of any functional faults in, for example, the control system 6, the power supply 3, 37 or the detectors 9, 11 and in the event of any tampering with the fire protection system 31. The different function profiles and operating profiles and different test sequences for service of the fire protection system 31 can be set by means of the control system 6.

Sensor systems 13, 22 can comprise one or more sensor modules 44 that constitute parts of the actual basic unit 32 or, alternatively, the sensor systems 13, 22 can comprise separate sensor modules 45 arranged in or on additional systems. The sensor modules 44, 45 can also be modular in construction with one or more separate detectors 9, 11.

The said sensor systems 13, 22 can comprise a plurality of different detector devices 9, 11/sensor modules 44, 45 for active detection of the particular risk environment, in addition to the detection of smoke and heat, such as movement detectors (are there any people on the premises?), clock for telling the time (day or night can, for example, determine who is to be notified in the event of fire) and sensors for various data relating to the development of the fire during operation, such as increasing or decreasing temperature, spread of combustion gases to which areas, etc. The type and sensitivity of the sensor can be affected by the choice of detection principle or by a combination of different detection principles (such as optical or chemical detection). All communication and signal information between the basic system 31/basic unit 32 and its additional systems/units is carried out via the control system 6 and can be carried out via a wireless and signal-coded communication system 40, see FIG. 2, or via a fixed signal link/signal transmission via cable or fibre, in accordance with the requirements of the client.

Figure 2:
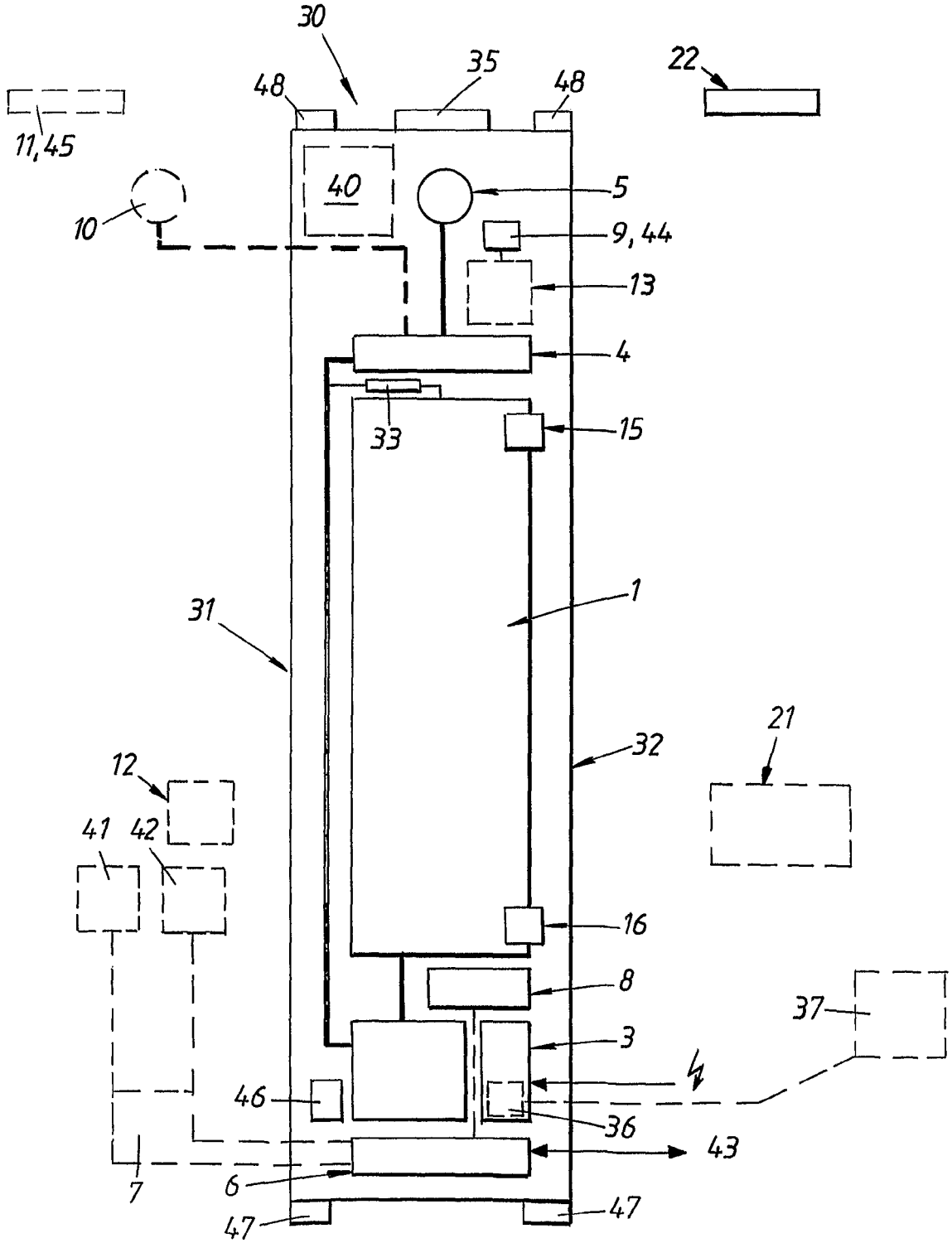
FIG. 2 shows a schematic drawing of parts of a second embodiment of the present fire protection installation in which particular additional modules and function profiles have been added to the basic system according to FIG. 1.

FIG. 2 shows a schematic drawing of parts of a second embodiment of the present fire protection installation 30 in which particular additional modules and function profiles have been added to the basic system 31 according to FIG. 1. When this is considered advantageous for the selected pressurizing system 2, the fire protection system 31 can be provided with a reserve power unit 37 to make possible electrical operation without access to a mains supply 3 or inbuilt battery 36. An integrated control unit 8 can be connected to the control system 6 with a separate panel for system information, or alternatively an externally-mounted control panel 12, for manual activation and/or de-activation, control and monitoring of the fire protection system 31. The abovementioned input 43 for data to be read off manually and for manual modifying of the software in the control system 6 is suitably arranged here or directly on the control unit 6. The functions in the control unit 8/control panel 12 incorporate a security solution that prevents inadvertent operation of these. The fire protection system 31 can be provided with a soft-start function/soft-start unit 46 in order to reduce short-term energy loads. FIG. 2 also shows schematically a plurality of adjustable feet 47 arranged on the underside of the basic unit 32 for ensuring that the basic unit 32 is perpendicular in relation to the base on which it is standing. There is also a sufficient number of fixing devices 48 or specially-designed stabilizers 35 to provide a stable fixing of the basic unit 32 to an existing wall, ceiling and/or floor.

As an addition to the basic system 31, the control system 6 and each sensor system/unit 13, 22 can be equipped with extra detector devices 11 at a distance from the basic unit 32, such as wireless detectors, etc. The mist-sprayer function can be activated manually, for example by means of an alarm button or from the control panel 12, but the fire protection installation 30 preferably comprises at least two separate detector devices 9, 11, connected by wires or by wireless means to the control system 6 of the basic unit 32. Each detector device 9, 11 suitably comprises the said combination detector/sensor module 44, 45 for both combustion gas detection (for example an optical smoke detector) and temperature detection. This is so that an early and reliable detection can be achieved without false alarms. The function of the detectors 9, 11 or the detector devices 44, 45 is then suitably such that at least two detectors 9, 11, 44, 45 have to detect combustion gas, whereas it suffices for only one detector 9, 11, 44, 45 to detect abnormal heat in order for an alarm to be given. The fire protection system 31 can be provided with different communication units 40, suitably with bi-directional communication, depending upon the required function or configuration. The fire protection system 31 can be equipped with an emergency lighting unit 41 which, by means of its design and function, makes escape/evacuation easier when visibility is reduced. The fire protection system 31 can be provided with an internal alarm unit 7 that can be modified, dependent upon the needs of the residents, with devices 42 for producing sound, light and vibration. In addition to setting off an internal alarm system 7 in order to alert persons in the immediate vicinity for fire fighting or evacuation, which can be carried out by means of an existing alarm system 7 or the special, abovementioned communication unit 40, for example a security alarm, telecommunications network, mobile telephone, Minicall service/pager and the like, external alarm units 21 can also be set off, to alert the police and fire brigade, in a similar way. An external sensor system 22 for monitoring, for example comprising a TV-camera or an IR-detector (Infrared), is also shown schematically in FIG. 2.

The fire protection system 31 can be provided with extra nozzles 10 for optimizing the extinguishing effect in special interior conditions or if spot protection is required for particular objects. The fire protection system 31 can be provided with a valve device/valve system 4 that makes it possible to select particular mist-sprayer pipe circuits 34 A, 34 B in multi-nozzle solutions 5, 10 and to carry out sequential control of several mist nozzles 5, 10 in a particular sequence. The valve system 4 is controlled from the control system 6 in a way that minimizes system fluctuations (unwanted mechanical forces as a function of pressure). Several areas and rooms can be protected by the same basic unit 32, via the additional external mist-spraying nozzles 10 and by means of a possible doubling of the sensor units 13, 22 and the valve system 4, see FIGS. 3, 7. The control system 6 can handle data from one or more detector devices 9, 11, 44, 45 and, via the valve device 4, can cause the extinguishing medium to be sent to the selected mist-sprayer pipe circuit 34 A, 34 B and in this to the correct nozzle or nozzles 5, 10.

Figure 3:
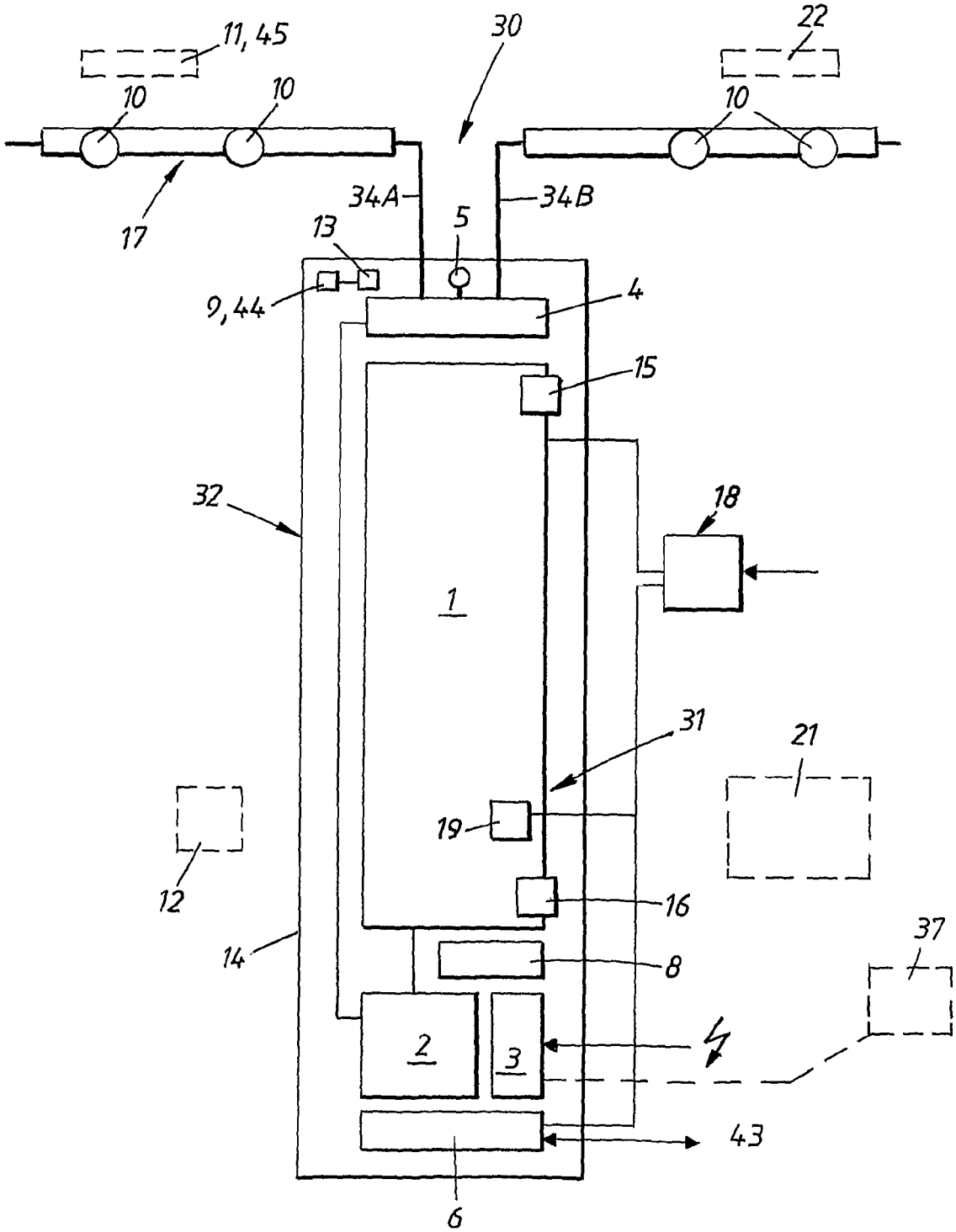
FIG. 3 shows a schematic drawing of parts of a third embodiment, particularly suitable for a multi-room application.

FIG. 3 shows a schematic drawing of parts of a third embodiment of the present fire protection installation 30, which embodiment is particularly suitable for such a multi-room solution, in that certain additional or alternative additional modules and function profiles have been added to the basic system 31 according to FIG. 1 and the second embodiment according to FIG. 2. The multi-room solution comprises, in addition to what has been described above, a valve device 18 for automatic filling of extinguishing medium into the extinguishing medium container 1 in order thereby to prolong the operating profile of the fire protection system 31. The filling is controlled by the control system 6 utilizing level detectors 19 that are suitably arranged in each extinguishing medium container 1. In addition, if the level of the extinguishing medium is judged to be low in relation to the possible development of the fire and the response time of external fire-fighting units, it is possible to cause the mist to be sprayed intermittently, that is in bursts, divided between one or more mist nozzles 5, 10 by means of the function profiles that are programmed into the control system 6.

The multi-room solution utilizes a modular distribution system 34 that is easy to install for distribution of extinguishing medium under high pressure, which distribution system 34 comprises different components such as lengths of pipe and external/additional nozzles 10, which can suitably be concealed, for example, in a ceiling cornice 17 and other mouldings for discrete/concealed pipe system installation 34. Another solution is to integrate the fire protection installation 30 in, for example, a piece of furniture, which results in a very discrete solution without interfering with the actual object that is to be protected.

Figure 4:
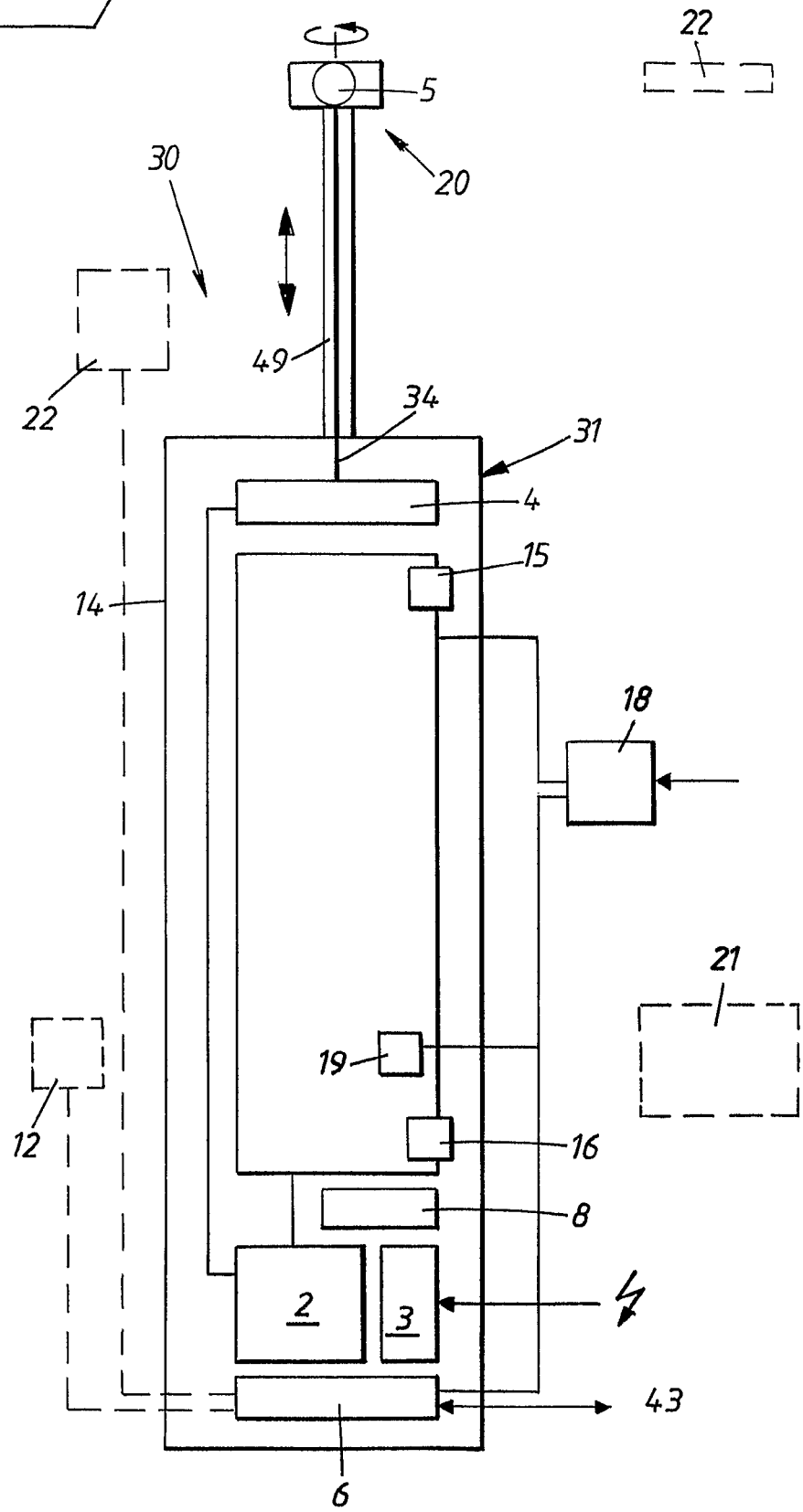
FIG. 4 shows a schematic drawing of parts of a fourth embodiment, particularly suitable for a more central location in the actual space to be protected.

FIG. 4 shows a schematic drawing of parts of a fourth free-standing embodiment that is particularly suitable for a more central position in the actual space that is to be protected, see also FIGS. 13 *a-b*, or when larger areas are to be covered by the extinguishing medium mist. This can be achieved by one or more fixed nozzles 5 for any area of coverage being mounted in a nozzle unit 20 on a mast 49 and in this way increasing the range of the extinguishing medium mist. The mast 49 can be provided with a telescopic device and its height can thereby be adjusted, for example it can be raised or lowered, upon activation in order to enable the nozzle unit 20 to be at an optimal height for maximal extinguishing effect (mist-spraying action). The height of the telescopic mast 49 can, if so required, also be adjusted during the active operating profile of the fire protection system 31 in order to make possible this maximal extinguishing effect.

If required, the nozzles 5 can be mounted on a nozzle device/unit 20 that rotates through 360 degrees or operates sequentially, in order to obtain an even spray pattern with a circular protective effect of the extinguishing medium mist and in order to be able to cover a larger area. It is also possible for the different nozzles 5 comprised in the nozzle device 20 to be able to be controlled as far as their timing is concerned, that is they can operate continually or intermittently, both with regard to flow and to pressure, so that the volume and liquid content of the cloud of mist that is created can be regulated. In the case when large areas are to be covered, it can be expedient to have an external manual control 12, 21 for activation and de-activation of the fire protection system 31 and an external sensor system 22 for monitoring of this.

For the alternative with the rotating nozzle unit 20, the pressure in the pipe distribution system 34 is utilized as propulsive power via a mechanical device, or alternatively via an electrical motor with gearing, not shown. For non-rotating units 20, several nozzles 5 are utilized with different spray patterns in a sequential activation pattern. This is in order to create an evenly distributed mist spraying with the necessary density within a particular area and volume in relation to the location of the fire protection system 31/basic unit 32.

Figure 5:
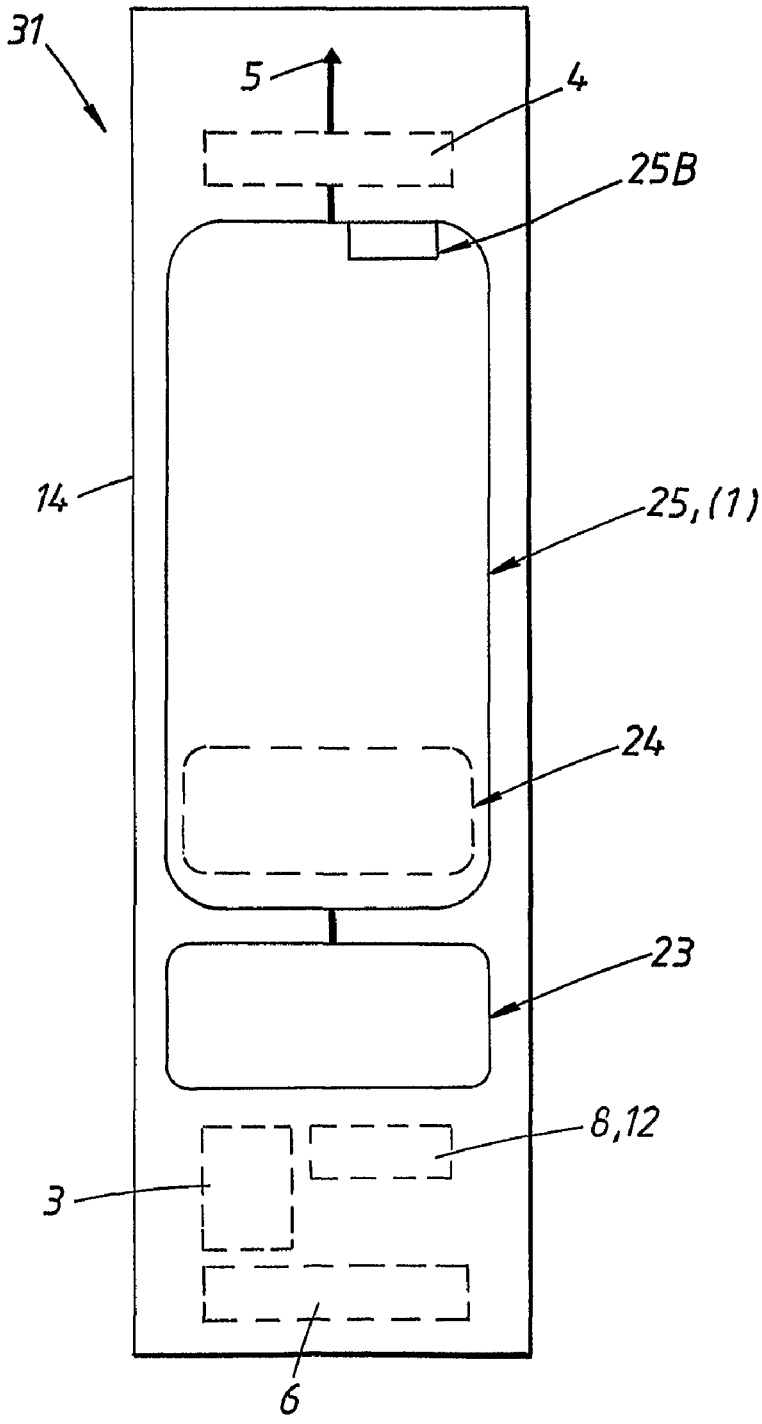
FIG. 5 shows a schematic drawing of parts of a fifth embodiment comprising a pressure vessel for extinguishing medium liquid, in which particular additional or alternative additional modules and function profiles have been added to the basic system according to FIG. 1.

FIG. 5 shows a schematic drawing of parts of a fifth embodiment comprising an alternative to the pressurizing system 2 described above. Instead of pressurizing the extinguishing medium separately outside the extinguishing medium container 1 by means of an externally-located pressurizing system 2, for example a pump, the extinguishing medium container 1 is pressurized directly by means of an external 23 or integrated 24 pressurizing system in relation to the extinguishing medium container 1, which pressurizing system is arranged outside or inside the extinguishing medium container 1 of the pressure vessel type 25. In this case, the container 1 is designed as a pressure tank 25 that, due to a suitable choice of shape and material, can withstand the pressure that is to be used for the function in question. The pressure tank 25 can be pressurized by a propellant gas vessel/gas cylinder 23, 24 with a suitable pressure and volume or by means of a pyrotechnic gas generator 23, 24 inside or outside the pressure tank 25 via a valve 100. As an alternative, a particular small quantity of extinguishing medium can be arranged in a separate pressure tank 25B as a supplement to the ordinary liquid extinguishing medium container 1.

Figure 6:
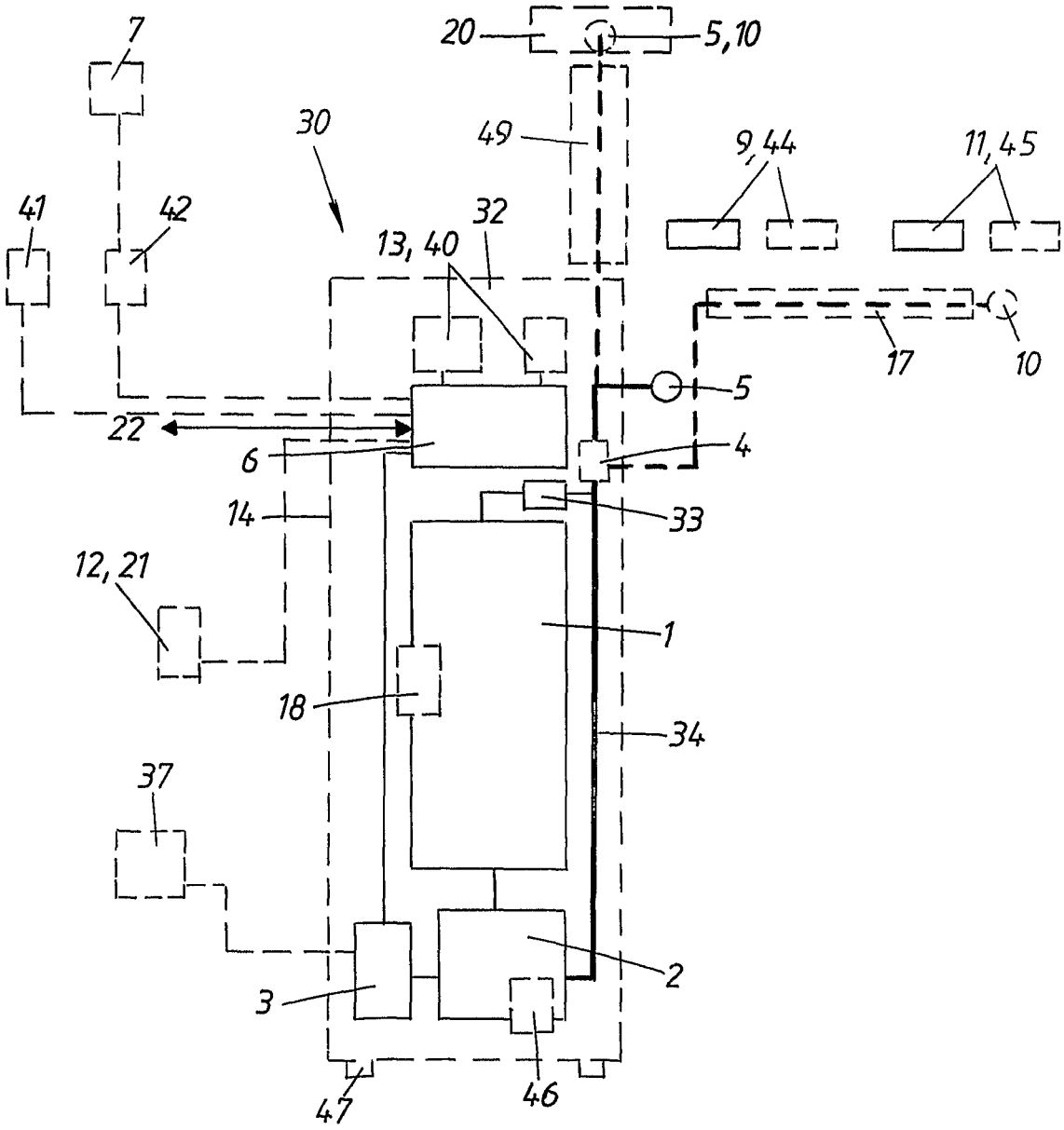
FIG. 6 shows a schematic drawing of parts of a sixth embodiment of the present fire protection installation.
Figure 7A:
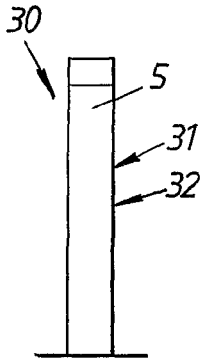
FIGS. 7: a-7: f show some schematic examples of different risk environments suitable for the present fire protection installation and its different embodiments.
Figure 7B:
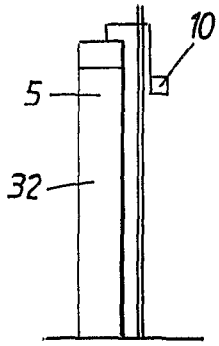
Figure 7C:
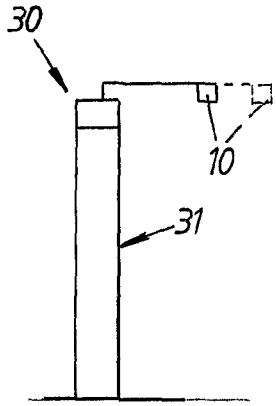
Figure 7D:
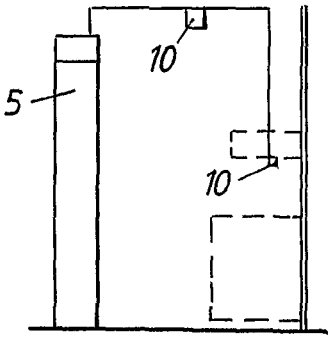
Figure 7E:
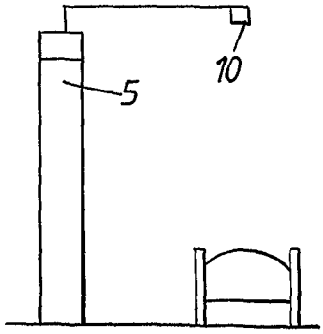
Figure 7F:
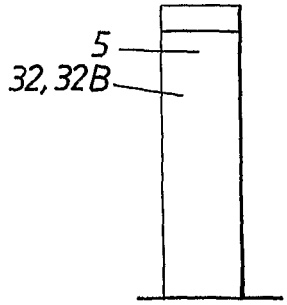

FIG. 6 shows a schematic drawing of parts of a sixth embodiment of the present fire protection installation 30, which comprises an assembly of most of the modules, units and additions described above.

FIGS. 7: a-7: f show schematically a number of different embodiments of the present fire protection installation 30 located in a number of risk environments, which embodiments comprise a basic unit 32 comprising a basic system 31, a basic unit 32 with an additional mist-spraying nozzle 10 in an adjacent area, an embodiment with a ceiling-mounted nozzle 10, two additional nozzles 10 in the ceiling for a particularly vulnerable risk object (a stove), an installation that is designed to deal with smoking in bed and a doubled basic unit 32 for longer operating times.

Figure 8:
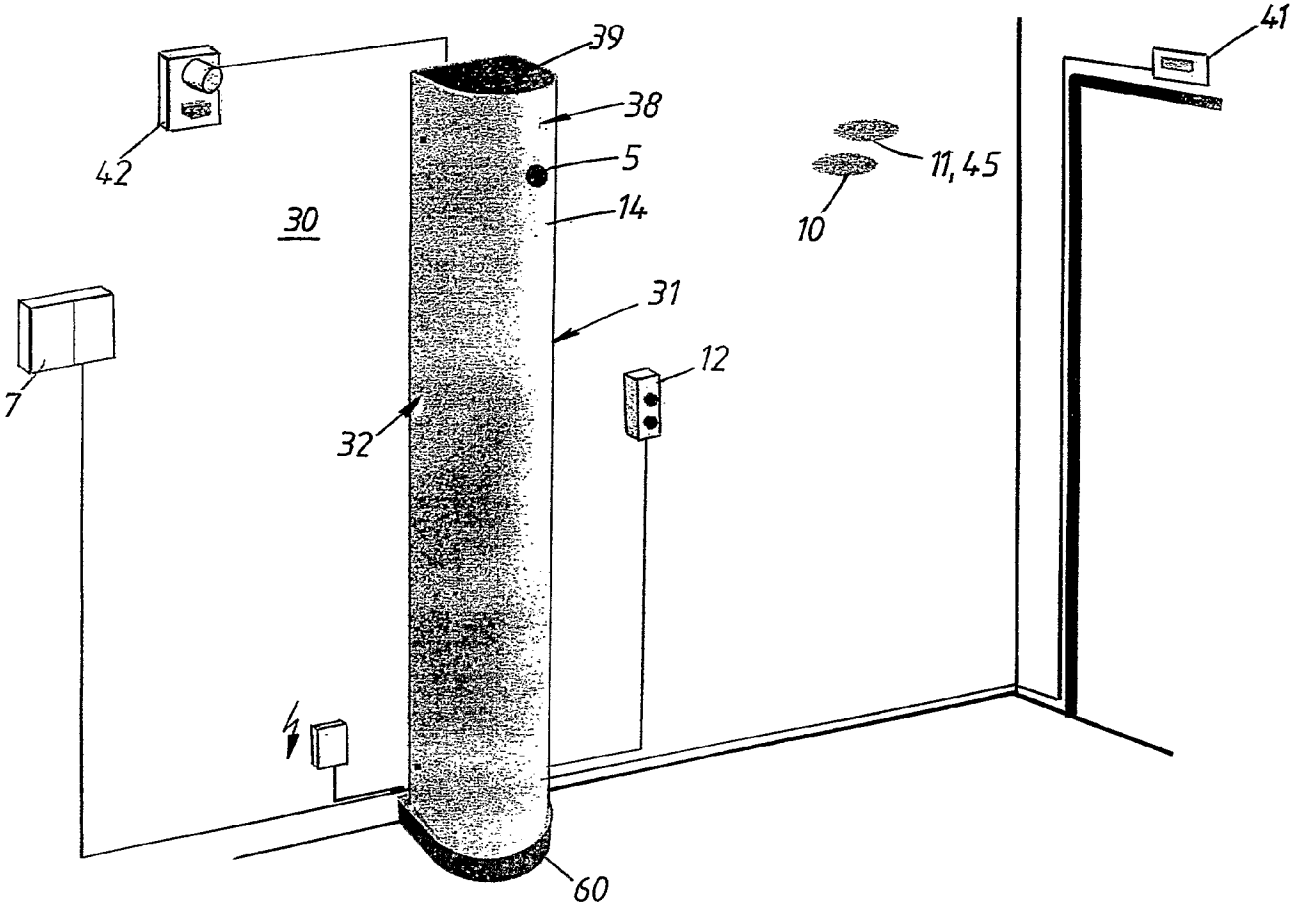
FIG. 8 shows schematically, and in side view, parts of a seventh embodiment comprising separate sensor, alarm and control systems.

FIG. 8 shows schematically, and in side view, parts of a seventh embodiment that is connected to the power grid, comprising additional external sensors 11, control panel 12 and alarm system 7 and emergency lighting 41, sound and light alarm 42.

Figure 9B:
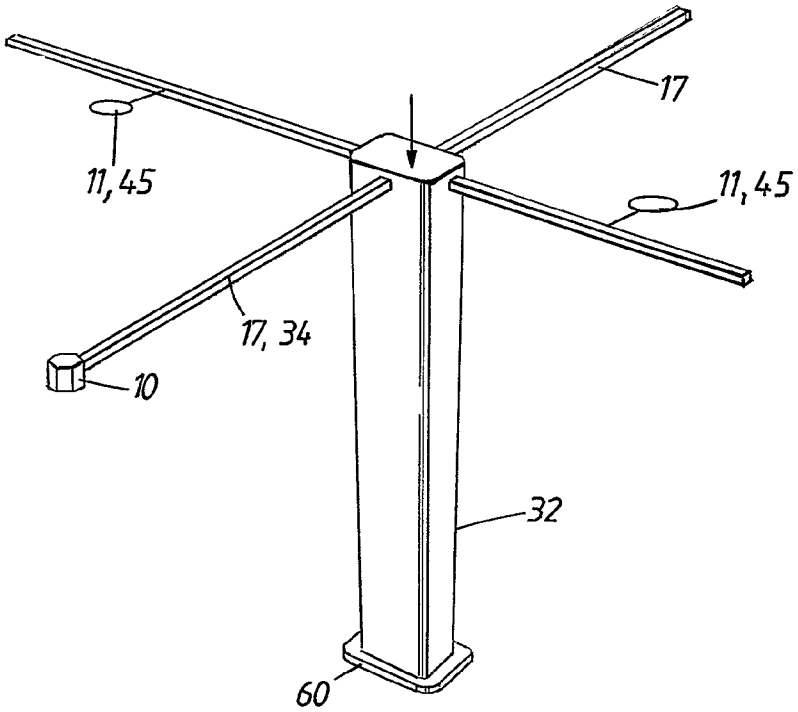
FIGS. 9*a-b* show schematically parts of an eight and a ninth embodiment comprising respectively a doubled fire protection installation and mouldings and/or ducts designed, for example, for communication with external detectors and for sending extinguishing medium to external mist-spraying nozzles and the like that are at a distance from the basic unit.
Figure 9A:
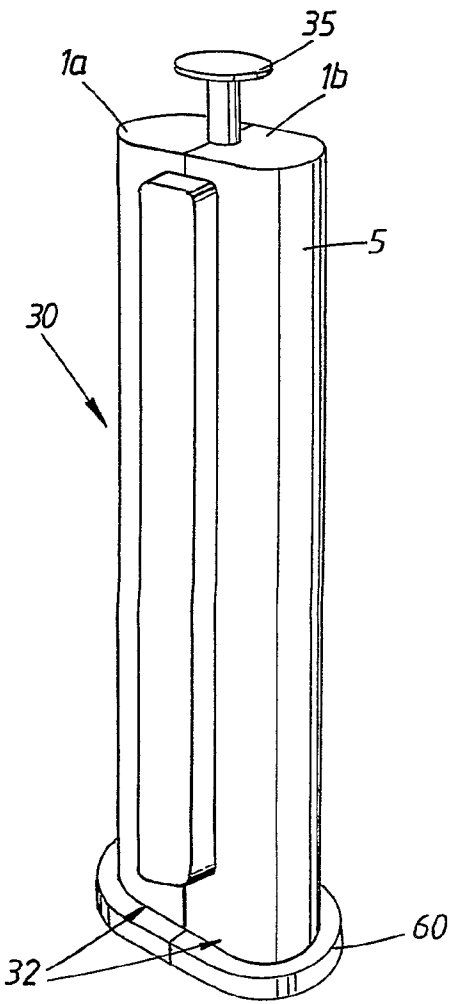

FIG. 9*a* shows schematically a doubled fire protection installation 30 comprising two container halves 1*a*, 1*b* with stabilizers 35 that can be raised to make contact with the ceiling and that can also serve as connection points for electricity, water or data.

FIG. 9*b* shows ceiling mouldings 17 for ducts for wires intended, for example, for communication to and from external detectors 11, and distribution pipes 34 intended for the conveyance of extinguishing medium to external mist-spraying nozzles 10 and the like at a distance from the basic unit 32.

Figures 10A, 10B, 10C:
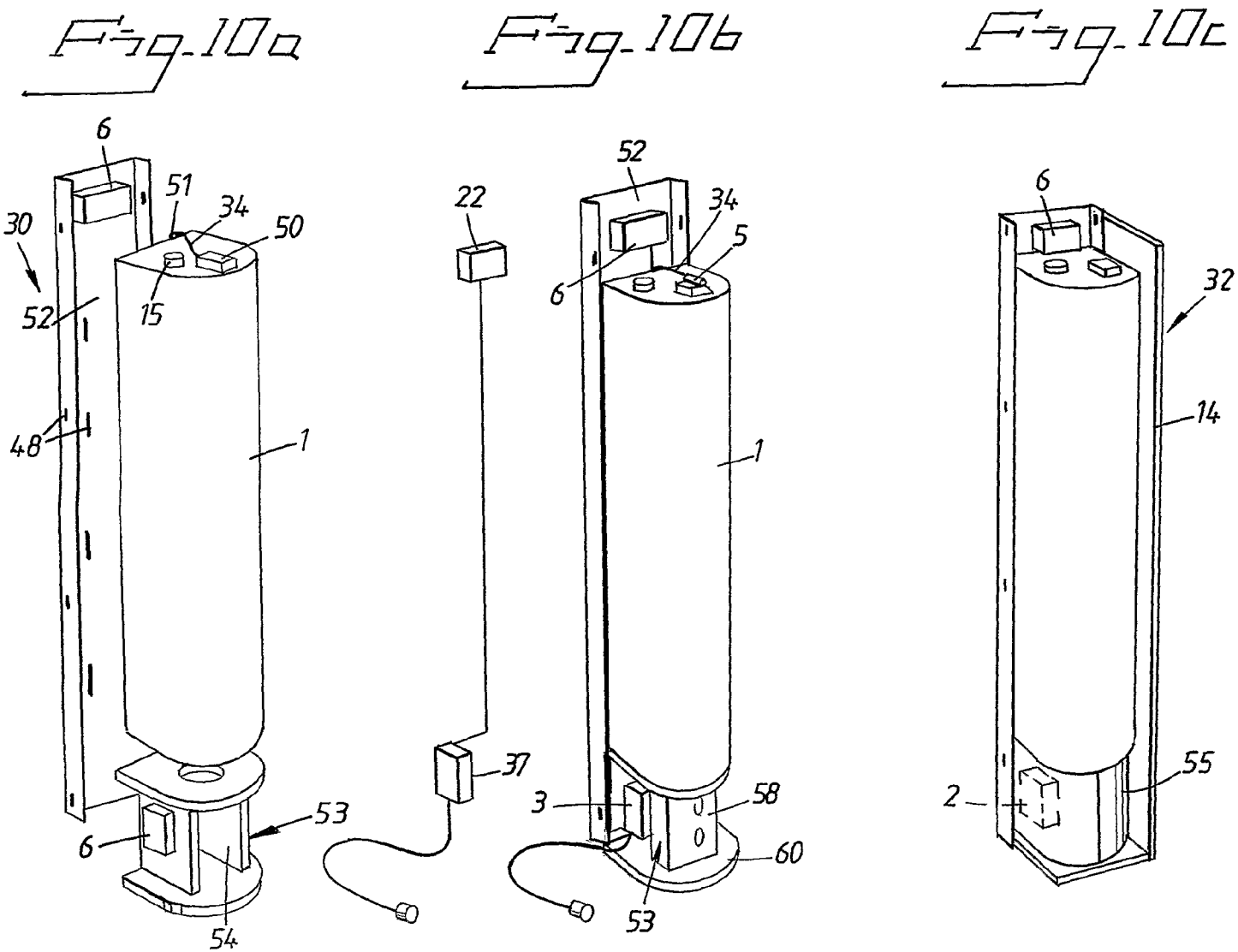
FIGS. 10 *a-c*, FIGS. 11 *a-e* and FIGS. 12 *a-e* show schematically particular internal parts of a fire protection installation according to the invention, and the possible location of these in a fire protection installation according to the invention.
Figure 11D:
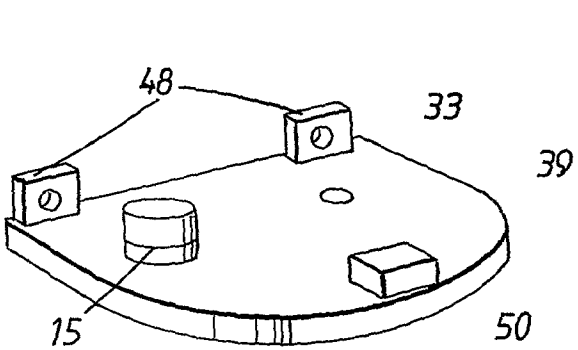
Figure 11E:
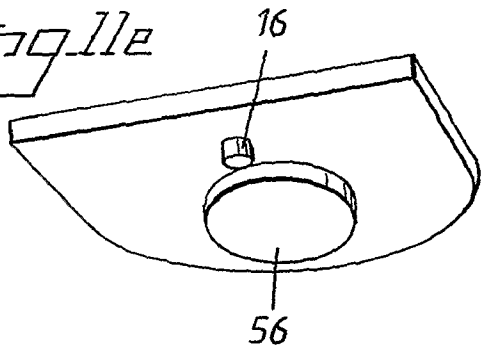
Figure 11B:
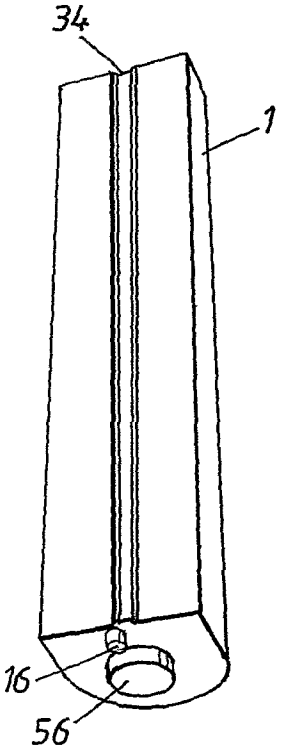
Figure 11C:
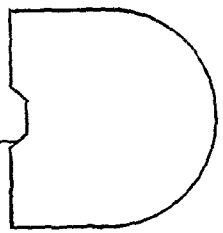
Figure 11A:
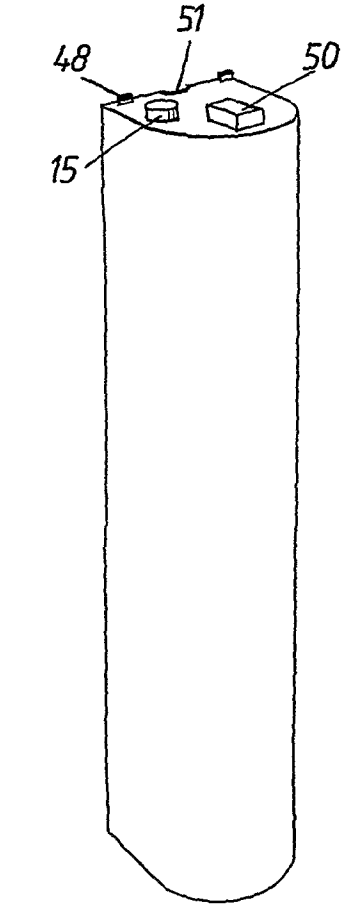

FIGS. 10*a-c* show schematically particular internal parts comprised in a fire protection installation 30 according to the invention, in which FIG. 10*a* shows an extinguishing medium container module 1 with filling valve 15 with cover, attachment surface 50 for a nozzle 5, duct 51 for pressure pipe system 34, back plate 52 with fixing device 48 for wall-mounting and for mounting the casing 14 and, at the bottom, a supporting stand 53 for the extinguishing medium container 1 comprising spaces 54 for electronics, hydraulics and mechanics, here, for example, the pressurizing system 2 and the power supply unit 3. FIG. 10*b* shows also a mist-spraying nozzle 5 with an upper end of a pressure pipe system 34, a control unit 6 and a power supply unit 3 mounted on the back plate 52 and the supporting stand 53 respectively. FIG. 10*c* shows, in addition, a part of an outer casing 14 of the basic unit 32 and an inner pump housing shield 55, here divided into two, for the said supporting stand 53 with spaces 54 integrated therein, containing, for example, the pressurizing system 2, the power supply unit 3, the control unit 8, the control system 6, etc.

FIGS. 11*a-e* show schematically an extinguishing medium container module 1 comprising the duct 51 for the pressure pipe system 34 along the back of the extinguishing medium container module 1, the valve 15 for manual filling with cover, the fixing surface 50 for a mist-spraying nozzle 5, wall fixings 48, a pressure-relief valve/pressure-reducing valve 33 for the air supply that replaces the extinguishing medium during operation so that a vacuum is not created in the extinguishing medium container 1 during emptying, guide 56 for mounting the extinguishing medium container 1 onto the supporting stand 53 for the pump housing 55 and connection to the pressurizing system 2 which also serves as a drawing-off valve 16.

FIGS. 12*a-e* show schematically the supporting stand 53 for the pressurizing system 2 with guide hole 57 for mounting the guide 56 on the extinguishing medium container 1 the said space 54 for the pressurizing system 2, here an electric pump, etc, and diverse cover plates 58 and supports 59 for the pump 2.

Figure 13B:
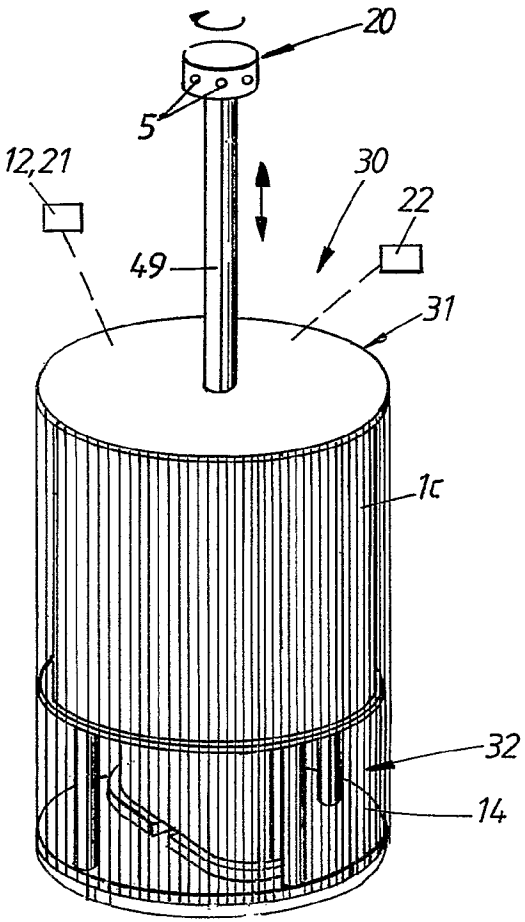
FIGS. 13 *a-b* show schematically parts of an additional embodiment according to the invention, comprising a telescopic mast with rotating or "intelligent" nozzles controlled by a selected function profile.
Figure 13A:
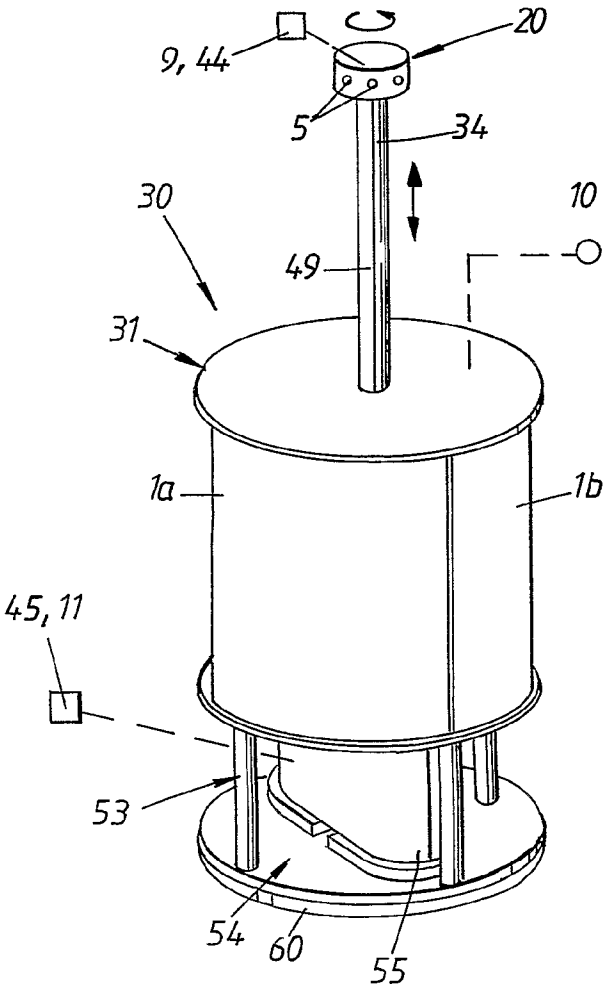

Finally, FIGS. 13*a-b* show schematically two examples of additional embodiments according to the invention, comprising the said telescopic mast 49 with rotating or "intelligent" nozzle units 20 controlled by the selected function profile, where one in particular shows a doubled fire protection system 31, each system having a separate extinguishing medium container half 1 a, 1*b*, and the other shows a larger common container 1 *c*.

Exemplary Embodiment

In a specially-tested embodiment of the invention, it has been found expedient to utilize a pressure of approximately 100-150 bar, preferably 130 bar, and a flow of approximately 8-10 litres/minute, whereby an operating time, that is a running time for the pressurizing system 2, in this case a high-pressure pump 2, was achieved of between approximately 12-30 minutes which was satisfactory for the volume in question of approximately 60 cubic metres. For larger volumes, it is expedient to utilize several basic units 32, that have control systems 6 that are interconnected, and an extinguishing medium volume of more than 100 litres is recommended in this case. For a ceiling height of higher than 0.5 metres above the top of the basic unit 32, this should be supported on a plinth 60, see FIG. 8, to achieve the best effect.

DESCRIPTION OF FUNCTION

The function and the use of the active, portable fire protection installation 30 according to the invention are as follows.

The function profiles and operating profiles contain automatic activation functions for all the sub-functions comprised in the fire protection system 31 in order to be able to be adapted to different user profiles (such as technical, social, economic and/or cultural values), configuration solutions (for example geometric) and the actual development of the fire (physical, including operating time and response time). The fire protection installation 30 is thus autonomous and does not normally require any manual intervention.

As there is normally a limited quantity of extinguishing liquid available in the extinguishing medium container 1 of the fire protection system 31, the control system 6 is arranged for different operating modes with the object of controlling the spraying of mist with regard to time and the development of the fire, that is keeping down the consumption of liquid and fighting a fire that is developing for a maximal operating time, preferably corresponding to the time that the fire brigade will take to arrive, while at the same time the development of the fire is retarded so that it does not constitute an immediate danger to life.

The operating modes can be divided into three different categories, namely "Adaptive operation" that responds to the size and intensity of the fire, "Intermittent operation" comprising a fixed schedule of operation and "Continuous operation".

In the "Adaptive operation" operating mode, the fire detectors 9, 11, etc, in the fire protection system 31 do not only constitute a sensor unit 13, 22 that indicates that a fire has arisen. In this operating mode, the fire detectors 9, 11, 44, 45 in the comprised sensor units 13, 22 are used to measure continuously the actual intensity and development of the fire over time. By means of this procedure, the fire protection system 31 can be activated and de-activated on the basis of the relevant values that are measured by all the sensor systems/units 13, 22 in the fire protection system 31. An optimal utilization of the available extinguishing medium can be achieved in this way.

In the "Intermittent operation" operating mode, a previously-programmed schedule is utilized that controls activation and deactivation of the fire protection system 31 with regard to pressure, flow and timing, after a fire has been detected. Intermittent operation can be used, for example, if the time that it takes for the emergency services to arrive after the alarm is given exceeds the operating time. The control system 6 can be programmed with any schedule. As previously-programmed options, there can be several, for example four, schedules that are adapted for the normal conditions that are to be found in the risk environments where the fire protection system 31 is to be installed. By means of intermittent operation, the time that the fire protection system 31 can protect an object is increased considerably. The control is carried out in such a way that mist-spraying nozzles/nozzle units 5, 10, 20 that are located in different places are used in bursts at the same time, or consecutively in a particular sequence, depending upon the likely development of the fire.

When an alarm has been detected, the control system 6 gives the alarm by means of sound and light signalling devices 42 (mounted in the basic unit 32 or on an external control panel 12). After an adjustable time delay (default 5 seconds), the pressurizing system 2 starts up and it will then stop and start in accordance with the pre-programmed control schedule. The control schedule can, in turn, be controlled by temperature sensors (the separate sensors 9, 11 or the temperature sensors 9, 11 integrated in the sensor modules 44, 45). The total time that the pressurizing system 2 is in operation is equal to the operating time and is determined by the volume of the container 1 and the flow through the mist nozzles 5, 10, 20. The total time during which the pressurizing system 2 is started and stopped throughout the whole control schedule is called here the alarm time and can be in excess of 20 min. During the alarm time, a relay is operated by the control system 6 that can be used for different alarm functions.

For "Continuous operation", the volume of the container 1 is designed for a time corresponding to the normal call-out time of the local emergency services. By utilizing continuous operation, the highest possible level of protection is obtained. This operating mode should be used in most cases. When an alarm has been detected, the control system 6 gives the alarm by means of sound and light signalling devices 42 (mounted in the basic unit 32 or on the external control panel 12). After an adjustable time delay (default 5 seconds), the pressurizing system 2 starts up and stops again after an operating time determined by the volume of the container 1 and the flow through the mist nozzle 5, 10, 20 (default 12 minutes). During the Operating time, a relay is operated by the control system 6 that can be used for different alarm functions.

At least two separate points in the room should be detected, preferably approximately 3 metres apart, in order to minimize the risk of false alarms. It is recommended that there should be one or more combination detectors 44, 45 with a combination of temperature sensor and optical smoke detector to provide good functionality with a very low risk of false alarms. Alarm conditions for the detectors 9, 11, 44, 45 are that two detectors 9, 11 must detect smoke or that either of the detectors 9, 11, 44, 45 gives an alarm as a result of the temperature.

As a result of the modular construction of the fire protection installation 30 and the facility to set different function profiles and operating profiles via the intelligent control system 6, changes to suit different applications can be made in a simple way. The settings primarily affect the sensitivity of the sensor systems/units 13, 22 but also affect any time delay after the detection of a fire, type of operation that is required, etc.

Hospital Wards

For hospital wards, the basic system 31 is used with the addition of a communication unit 40 for the alarm system 7, 21 in question. The provision of activation and de-activation from an operating centre/control panel 7, 8, 12, 21 can be added. A light or sound alarm 42 can be provided in order to draw attention to incidents and for marking the actual location of the incident. The system 31 can be supplemented with a control unit 8/control panel 12 when this is considered expedient.

The operating profile is characterized by:
evaluated risk (low)
the probability of interference that can cause false alarms (low)
call-out time for emergency personal (5 min)
own ability to escape (low)
operation (continuous)
control unit 8, 12 (yes)
emergency lighting unit 41 (yes)
sound/light alarm 42 (no)
time delay (no)

Homes for the Elderly

For both institutional and private homes for the elderly, the basic system 31 can be provided with both internal alarm functions 42 and external alarm communication 40 (for individual residences in, for example, private dwellings, the external alarm can be connected via a fixed telephone line, mobile telephone or via an existing security system). For these types of residence, it is also possible to connect additional spray nozzles 10 for the protection of several rooms or for spot protection of kitchen areas or bedrooms. The operating profile and the addition of function units can be optimized for the relevant risk situation. The operating profile is characterized by:
evaluated risk (high)
the probability of interference that can cause false alarms (high)
call-out time for emergency personnel (15 min)
own ability to escape (low)
operation (continuous/intermittent)
control unit 8, 12 (yes/no)
emergency lighting unit 41 (yes)
sound/light alarm 42 (yes/no)
time delay (yes (if control unit 8)/no)

Day Rooms

For day rooms, either the basic unit 32 or alternatively the free-standing system solution with 360 degrees effect can be utilized. For larger areas/volumes, fire protection systems 31 can be doubled and can also be arranged to work together. Different communication solutions are possible by means of different optional units 40. The operating profile is characterized by:
evaluated risk (high)
the probability of interference that can cause false alarms (high)
call-out time for emergency personnel (10 min)
own ability to escape (medium)
operation (adaptive/continuous/intermittent)
control unit 8, 12 (yes)
emergency lighting unit 41 (yes)
sound/light alarm 42 (yes)
time delay (yes)

Evacuation Routes

For evacuation routes, there can be different system configurations depending upon the situation and plan of the routes.
The operating profile is characterized by:
evaluated risk (low)
the probability of interference that can cause false alarms (medium)
call-out time for emergency personnel (15 min)
own ability to escape (high)
operation (adaptive/intermittent)
control unit 8 (yes)
emergency lighting unit 41 (yes)
sound/light alarm 42 (yes)
time delay (no)

Private Dwellings

In principle, the same solution as for homes for the elderly, but a fire protection installation 30 comprising a larger capacity in order to protect several rooms can also be advantageous. Great variation in the configuration depending upon on the residents' requirements and special capacities/disabilities.
The operating profile is characterized by:
evaluated risk (medium/low/high)
the probability of interference that can cause false alarms (high)
call-out time for emergency personnel (>15 min)
own ability to escape (medium)
operation (adaptive/continuous/intermittent)
control unit 8, 12 (yes/no)
emergency lighting unit 41 (yes/no)
sound/light alarm 42 (yes/no)
time delay (yes (if control unit 8)/no)

Jail Rooms/Prison Cells/Psychiatric Wards

For these areas, the basic system 31 is used, provided with suitable alarm communication 40 and tamper proofing.
The operating profile is characterized by:
evaluated risk (high)
the probability of interference that can cause false alarms (high)
call-out time for emergency personnel (5 min)
own ability to escape (no)
operation (adaptive/continuous)
control unit 8 (no)
emergency lighting unit 41 (no)
sound/light alarm 42 (no)
time delay (no)

Hotel Rooms

For these areas, the basic system 31 is used, provided with suitable alarm communication 40 and tamper proofing.
The operating profile is characterized by:
evaluated risk (medium)
the probability of interference that can cause false alarms (medium)
call-out time for emergency personnel (10 min)
own ability to escape (low)
operation (continuous)
control unit 8 (no)
emergency lighting unit 41 (yes)
sound/light alarm 42 (yes)
time delay (no)

Alternative Embodiments

The invention is in no way limited to the embodiments that have been described specially, but can be varied in different ways within the framework of the patent claims.

It is recognized, for example, that the fire protection installation 30 can also comprise a wall-mounted fire protection system 31. This system is mounted horizontally on a wall, advantageously close to the ceiling. Depending upon the construction of the wall, this method of mounting may require special wall-mounted supports that support the weight on the floor.

It is further recognized that the expressions "portable", "mobile", "active", "installation", etc, that are used above, mean that the present invention is different from stationary and essentially unchangeable fixed fire protection installations 30 that are incorporated in the actual object to be protected and that constitute a fixed part of the actual object to be protected and that are intended to work in the same way and in the same location for a long time, unlike the present automatically reacting active fire protection installation 30, that is temporary, that is only meant for a particular duration of time, and that is designed to be able to be moved relatively easily to a different temporary location or to be aimed towards a different area, object, etc, as quickly as the need for protection changes, while at the same time we do not mean a manually initiated, mobile fire-fighting unit or a passive response system of the fire extinguishing cylinder 1 type that is stored elsewhere and is not brought out and moved to the actual seat of the fire until after the fire has already been detected.

It is recognized that the number, size, material and shape of the elements and components comprised in the fire protection installation 30, for example the container 1, casing 14, 55, covering and supporting components 52, 53, 58, 59, 60, etc, will be adapted in response to the design and function requirement(s) that apply at the time. For example, the components can suitably be compression moulded, cast, etc, in one or more pieces and can be made of plastic or plate metal.

The invention claimed is:

1. A fire protection installation for installation in a determined risk environment, comprising;

a fire protection system in an enclosed space with at least one sensor system for active detecting of and reaction to sensor data determined for the risk environment, an extinguishing medium container containing a liquid extinguishing medium, a pressurizing system for pressurizing the liquid extinguishing medium, at least one mist-spraying nozzle for achieving fire suppression and/or fire extinguishing in the determined risk environment by means of the liquid extinguishing medium that is pressurized by the pressurizing system, and a pipe system arranged between the comprised extinguishing medium container, pressurizing system and at least one nozzle, wherein the at least one mist-spraying nozzle creates mist as an evenly distributed spread of drops from the liquid extinguishing medium that is pressurized by the pressurizing system to at least 100 bar, wherein the fire protection installation is portable for temporary installation in the determined risk environment, wherein the fire protection installation is adjustable for different risk environments and, wherein the fire protection installation is modular and comprises at least one basic unit, which can be moved, adjusted or reprogrammed if the risk environment changes, and wherein the fire protection system further comprises additional systems/units, which comprise different functions for which determined function profiles are adapted and programmed into a control system, the additional systems/units comprising at least one programmable microprocessor for controlling the fire suppression and/or fire extinguishing by the fire protection system in the determined risk environment, whereby the fire protection system sets and adjusts parameters for different function profiles, pre-selects the basic system and additional systems/units and associated determined function profiles in response to the determined risk environment, and changes function profiles in response to the detected actual development of the fire, wherein the fire protection system comprises a power supply unit.

2. The fire protection installation as claimed in claim 1, wherein the pressurizing system comprises an electric high-pressure pump that is driven via the power supply unit to obtain a pressure and flow through the comprised at least one mist-spraying nozzle that is adapted for the function profile.

3. The fire protection installation as claimed in claim 1, wherein the at least one mist-spraying nozzle creates a mist with a spray angle and projection that are adapted for the function profile.

4. The fire protection installation as claimed in claim 1, wherein the extinguishing medium container in the pressurizing system consists of a pressure tank, which comprises a valve for pressurizing the extinguishing medium in the pressure tank, and wherein the pressure tank is pressurized via the valve by a gas cylinder.

5. The fire protection installation as claimed in claim 1, further comprising a detector device for detection of different data associated with the fire being incorporated in the fire protection system and being arranged to communicate with the control system by wire, fibre or by wireless means, wherein the fire protection system comprises a communication unit for communication with the control system and with internal and/or external alarm systems.

6. The fire protection installation as claimed in claim 1, wherein the fire protection system comprises a valve device for a plurality of mist-spraying nozzles and the control system is arranged to handle data from one or more detector devices for causing the liquid extinguishing medium to flow via the valve device to at least one mist-spraying nozzle from among the plurality of mist-spraying nozzles, whereby the fire protection system is arranged to protect several areas.

7. The fire protection installation as claimed in claim 1, wherein the fire protection system comprises a nozzle device, which nozzle device comprises a mast on which a plurality of mist-spraying nozzles are mounted to increase the area that is covered by the extinguishing medium mist.

8. The fire protection installation as claimed in claim 1, wherein the at least one mist spraying nozzle is mounted on a rotating unit.

9. The fire protection installation as claimed in claim 1, wherein the fire protection system has a level detector on the container for controlling the automatic filling of the liquid extinguishing medium via a filling valve.

10. The fire protection installation as claimed in claim 1, wherein the fire protection system comprises a data input for manual reading off of data and modifying of the software/function profiles in the control system in response to a particular risk environment and/or in response to the particular fire protection installation configuration.

11. The fire protection installation as claimed in claim 1, wherein the pressurizing system comprises an electric high-pressure pump that is driven via the power supply unit to obtain a pressure and flow through the comprised at least one mist-spraying nozzle that is adapted for the function profile.

12. The fire protection installation as claimed in claim 1, wherein the pressure created by the pressurizing system is between 100 bar and 130 bar.

* * * * *